US005709585A

United States Patent [19]

Matsuo et al.

[11] Patent Number: 5,709,585

[45] Date of Patent: Jan. 20, 1998

[54] METHOD AND APPARATUS FOR REMOVING BURRS FROM JOINED BILLETS IN A CONTINUOUS ROLLING PROCESS

[75] Inventors: Giichi Matsuo; Nobuyoshi Hamura; Susumu Okawa; Hidenori Anai; Akira Sakai; Soichi Aoyama; Koji Okushima; Yuki Sugawara; Bunnosuke Ushioda; Yuji Watanabe, all of Tokyo, Japan

[73] Assignee: NKK Corporation, Tokyo, Japan

[21] Appl. No.: 703,396

[22] Filed: Aug. 26, 1996

[30] Foreign Application Priority Data

| | | | |
|---|---|---|---|
| Aug. 31, 1995 | [JP] | Japan | 7-223146 |
| Aug. 31, 1995 | [JP] | Japan | 7-223401 |
| Sep. 21, 1995 | [JP] | Japan | 7-243313 |
| Oct. 31, 1995 | [JP] | Japan | 7-282916 |
| Oct. 31, 1995 | [JP] | Japan | 7-282917 |

[51] Int. Cl.[6] ..... B24B 49/00; B24B 51/00

[52] U.S. Cl. ..... 451/5; 451/348; 451/211

[58] Field of Search ..... 451/348, 347, 451/211, 49, 5, 355; 228/201, 99, 125, 13, 212, 235.1, 44.3; 266/51, 52, 53

[56] References Cited

U.S. PATENT DOCUMENTS

| | | |
|---|---|---|
| 2,918,759 | 12/1959 | Konazewski et al. . |
| 3,667,165 | 6/1972 | McDowell et al. . |

FOREIGN PATENT DOCUMENTS

| | | |
|---|---|---|
| 1130871 | 2/1957 | France . |
| 3318865 A1 | 11/1984 | Germany . |
| 3721488 A1 | 1/1989 | Germany . |
| 52-20492 | 1/1977 | Japan . |
| 52-20492 | 2/1977 | Japan . |
| 52-37541 | 3/1977 | Japan . |
| 52-43754 | 4/1977 | Japan . |
| 57-11722 | 3/1982 | Japan . |
| 57-13361 | 3/1982 | Japan . |
| 783225 | 9/1957 | United Kingdom . |
| 995125 | 6/1965 | United Kingdom . |

*Primary Examiner*—James G. Smith
*Assistant Examiner*—Derris H. Banks
*Attorney, Agent, or Firm*—Frishauf, Holtz, Goodman, Langer & Chick

[57] ABSTRACT

A method for removing burrs in a continuous rolling process including the steps of joining the rear end of a preceding billet with the front end of a succeeding billet using a flash butt welding method while both billets are moving, and grinding a burr on the welded part of the joined portion using a plurality of grinders while the billets are moving and while rotating the grinders and moving the grinders synchronously with the travelling speed of the billets. A grinding machine for continuously rolling a round billet includes a travelling body shuttling along the direction of movement of the round billet, a turret ring rotatably supported by the travelling body, and a plurality of grinding devices arranged in a movable manner within a radius of the turret ring, wherein the grinding devices include grinders which are set at a tilted angle relative to the center axis of the rotatable turret ring. A grinding machine for continuously rolling a rectangular billet includes a travelling body moving along a moving direction of the rectangular billet, two pairs of grinding devices located at a front side and a rear side, respectively, of the travelling body and having grinders which rotate on a plane facing the rectangular billet and along a longitudinal direction of the rectangular billet, a moving device for moving the grinding devices in a right angle direction relative to the rectangular billet, and a device for moving the grinders to come close to and apart from the rectangular billet.

18 Claims, 14 Drawing Sheets

WAITING POSITION

WELD-COMPLETION POSITION

GRINDING START POSITION

GRINDING COMPLETION POSITION

METHOD AND APPARATUS FOR REMOVING BURRS FROM JOINED BILLETS IN A CONTINUOUS ROLLING PROCESS

FIELD OF THE INVENTION

The present invention relates to a method and an apparatus for removing burrs in a continuous rolling process where billets are joined together by flash butt welding.

DESCRIPTION OF THE RELATED ART

There are several proposals on the method for removing burrs from billets welded together to conduct continuous rolling. Examples of these methods are disclosed in JP-A-37541(1977) and JP-B-13361(1982), (the terms "JP-A-" and "JP-B-" referred to herein signify "unexamined Japanese patent publication" and "examined Japanese patent publication", respectively). However, they only describe examples of a trimmer for burr-removal, and they do not disclose a concrete method for grinding the burrs. As for the removal of burrs from the welded parts of round billets welded together using flash butt welding, JP-A-20492(1977) discloses a method in which an edge face of a rotating grinder contacts the surface of a round steel rod, and the surface of the round rod is ground by a revolution of the grinder around the rod center axis.

In a system of flash butt welding of billets followed by continuous rolling, the on-line removal of burrs from a flash butt weld part must be conducted within a short time, and the bur-removing operation is required to be substantial for a long period of time. Nevertheless, JP-A-37541(1977) and JP-B-13361(1982) do not disclose concrete methods for grinding burrs and does not deal with burrs on a flash butt weld part, though they proposed conceptual methods of burr-removal. In addition, the method proposed by JP-A-20492(1977) relates to the flash butt welding method, but the method has problems of offsetting the grinding center position owing to the abrasion of grinder and of lack of slag treatment. Thus the method is incapable of continuous grinding for a long period, and has no applicability to on-line commercial operation.

The present invention was completed to solve the above-described problems. The first object of the present invention is to provide a method for removing burrs on a flash butt welded part, which method allows to remove burrs on a plurality of billets successively on an on-line basis.

For a successive on-line operation of burr removal using a grinding method in a continuous rolling process, there are various issues to solve as listed below.

1) Control of rotation and turning of grinder, and completion of grinding of the grinding machine;
2) Sensor positioning and trigger setting for enabling the control;
3) Escape control of a roll while a burr passing thereunder; and
4) Means for supporting and feeding the billet within a moving range thereof between the welding unit and the grinding machine.

The second object of the present invention is to solve the above-described issues and to present a control method for a running grinding machine, which control method realizes successive removal of burrs generated during the flash butt welding in a continuous rolling process.

In a continuous rolling process where the successively cast billets are joined together at the inlet of a rolling mill using the flash butt welding method to form a continuous billet and where an endless rolling is conducted using thus joined billet in a rolling line, the rolling of an as-welded billet cannot give a satisfactory product because the uplifted portion on the welded part is left on the product as a scab or other defect. Consequently, the burrs on the welded part are required to be removed before entering the rolling mill.

Grinding has proved to be a most effective means of burr-removal. A critical issue with grinding is successive treatment of ground slag generated from successive grinding cycles without allowing accumulation thereof.

The successive treatment of the slag is a neck of the adoption of the grinding method in continuous rolling process. Owing to the important issue that was not solved, the method has not been brought into practical application, though the method is known for its usefulness.

The present invention successfully solves the above-described important issue, and the third object of the present invention is to provide a method for successively treating ground slag in a continuous rolling process.

In a process of continuous rolling of continuously cast billets, there is a known burr-removing unit (JP-A-43754 (1977) and JP-B-11722(1982)) where a running flash butt welding unit is used to successively joint billets using the flash butt welding method and where the burrs generated during the welding are removed using bite or the like. That type of burr-removing unit uses a total bite because the unit deals with square billets so that the unit has a problem of severe abrasion of bite.

On the other hand, there is a method dealing with round steel rods (JP-A-20492(1977), for example) where a plurality of grinders are used for removing burrs by turning the grinders around the steel rod. That type of burr-removing unit has, however, a structure to insert the unit from lateral direction to the steel rod. Owing to the structure, a single grinder among plurality thereof is able to open/close while others are stationary. As a result, when the grinders are abraded, the center of grinding circle become offset from the center axis of the steel rod. In addition, since the rotational axis of the grinder is parallel to the axial line of the steel rod, the slag of ground chips scatters at a right angle to the steel rod axis and adheres to the grinder, and makes the slag collection difficult. Thus on-line successive burr-removal is difficult.

Use of a grinder for removing burrs from flash butt weld parts is optimum for a billet continuous rolling process. The reason is that the time required for removing burrs is very short and that a feature of grinding with the grinder, or maintaining a stable grinding performance for a long period even after the grinder is abraded, is fully used.

There are, however, problems in the use of a grinder for removing burrs from flash butt weld parts. These problems include that successively appearing burrs on the billet welded parts are necessary to remove during on-line running movement, and that, since a lot of ground slag scatter as spark during the burr grinding operation, the slag treatment is required to adequately treat, and that the operating state is requested to quickly respond to the size change of billet. The above-described patent publications do not provide any effective means to solve these problems.

The present invention solves these problems, and the fourth object of the present invention is to provide a travelling burr-removal apparatus that grinds the burrs on welded parts of round billets successively and efficiently using grinders in a continuous rolling of round billet process.

When successively cast billets are joined together at the inlet of the rolling mill using the flash but welding method to form a continuous billet, and when thus formed billet is then rolled without treating the welded part thereof, the uplift of the welded part becomes a scab or the like which remains on the product surface to result in a defective product. Accordingly, the burrs on the welded part must be removed before entering the rolling mill.

For a square billet, a burr-removal apparatus is disclosed in JP-A-43754(1977) and JP-B-11722(1982). The disclosed burr-removal apparatus uses total bites or bites each of which faces individual sides of the square billet to remove burr on the welded part. That type of burr-removal apparatus has, however, disadvantages of suffering severe abrasion on the bite and of taking too much time for replacement of bite, so that type of burr-removal apparatus cannot be applied for a continuous rolling process that has a strict limitation on time cycle.

On the other hand, a grinding method using grinders has proved most effective to solve these problems. That type of method, however, generates a lot of ground slag so that a design for easy treatment of the slag is required. That is, the arrangement of grinders must assure the scattering of the ground slag to a specified direction.

The present invention was completed to respond to these problems, and the fifth object of the present invention is to provide an apparatus for removing burrs on a welded part of a square billet, which apparatus is best fit to the continuous rolling process of a square billet.

SUMMARY OF THE INVENTION

An object of the present invention is to solve the above-described problems and to provide a method for removing burrs and an apparatus for removing burrs for enabling continuous rolling of a billet.

The first aspect of the present invention, or a method for removing burrs in a continuous rolling process, comprises the steps of:

joining a rear end of a preceding billet with a front end of a succeeding billet using the flash butt welding method while travelling both thereof; and grinding a burr on the welded part of the joined portion using a plurality of grinders while travelling the billets and while rotating the grinders and moving thereof synchronously with the travelling speed of the billets.

The second aspect of the present invention, or a method for removing burrs in a continuous rolling process, comprises the steps of:

detecting a welded part on billets for continuous rolling, which billets were welded to join together by a travelling welding unit, using a sensor mounted to a travelling grinding machine located at a downstream of the welding unit;

presetting a plurality of grinders mounted to the travelling grinding machine and continuously rotating thereof to the billet immediately after detecting the welded part while moving the travelling grinding machine toward downstream of the billet travelling line up to a rolling speed of the billet at an accelerating rate;

detecting that the welded part of the billet arrived at the position of the grinders; and after detecting the arrival of the welded part of the billet, removing the burr on the welded part by fixing the grinders at the preset position while travelling the travelling grinding machine with the speed of the billet rolling synchronously.

The third aspect of the present invention, or a method for removing burrs in a continuous rolling process, comprises the steps of:

scattering ground slag generated by grinding a burr on a welded part of billet toward downstream of the billet travelling line within a limited direction during travelling the travelling grinding machine;

placing a hood at downstream of the grinding machine while facing the hood against the scattering direction of the ground chips, and forming a water film on an inner surface of the hood by flowing water down along the inner surface thereof; and collecting the ground slag by the hood for continuously flowing down the ground slag along with the water film.

The fourth aspect of the present invention, or a grinding machine for continuously rolling a round billet, comprises:

a travelling body traversing along the direction of the round billet movement;

a turret ring supported by the travelling body in a free-turning state;

a plurality of grinding devices arranged in a free-moving state along a radius of the turret ring; and grinders of the grinding device, which grinders are set at a tilted angle against the center axis of the turret ring.

The fifth aspect of the present invention, or a grinding machine for continuously rolling a square billet, comprises:

a travelling body traversing along the direction of the square billet movement;

two pairs of grinding devices being located at front side and rear side of the travelling body and having grinders which rotate on a plane facing the square billet and along the longitudinal direction of the square billet;

a means for moving the grinding device at a right angle to the square billet; and a means to make the grinders come close and apart from the square billet.

BRIEF DESCRIPTION OF THE DRAWINGS

FIG. 3(*b*) shows a cross sectional view of a burr generated at the joint section of the billets, after removing the burr using a flash butt welding unit.

FIG. 4(*b*) shows a schematic front view of the travelling grinding machine for removing burrs on the welded part of a square billet of the first aspect of the present invention.

FIG. 7(*b*) shows the state that a welded part arrives at beneath the grinder.

FIG. 11(*b*) shows the arrangement of vehicles and other equipment at a weld-completion position.

FIG. 11(*c*) shows the arrangement of vehicles and other equipment at a starting position for grinding.

FIG. 11(*d*) shows the arrangement of vehicles and other equipment at a grind-completion position.

FIG. 15(*b*) is a side view of the grinders for a square billet.

DESCRIPTION OF THE PREFERRED EMBODIMENT

1. Example of the first aspect of the present invention (Preferred mode 1 of the present invention)

Figure 1:
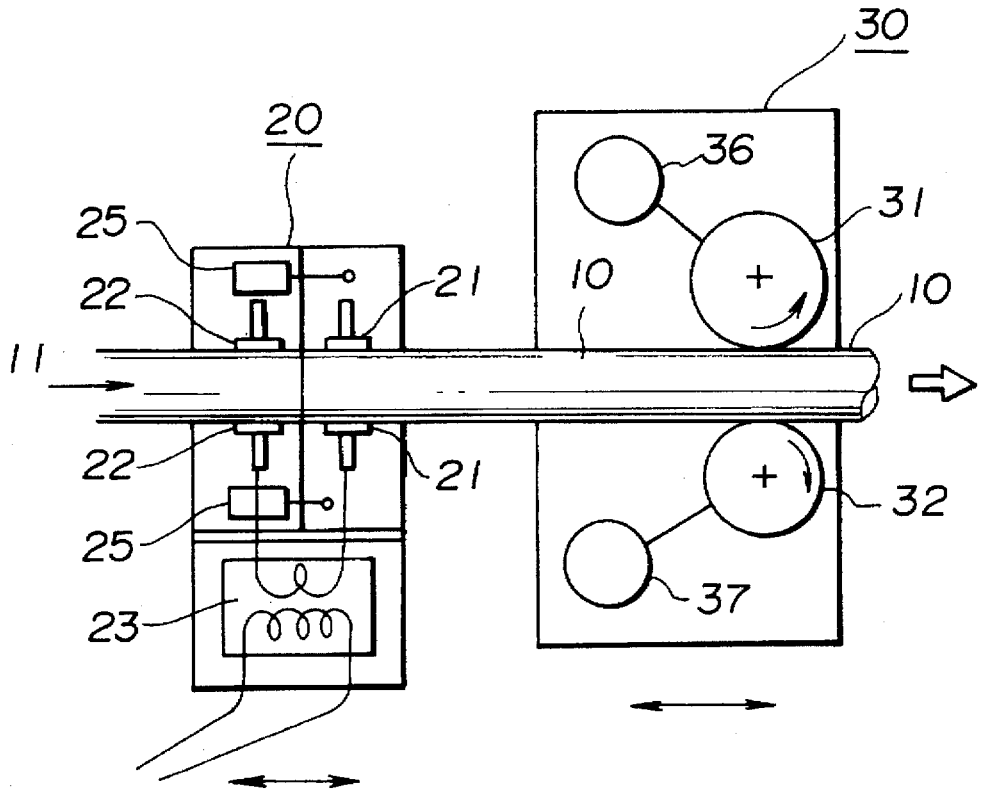
FIG. 1 is a schematic drawing of an example of the first aspect of the present invention showing the relation between the travelling grinding machine for removing burrs on the welded part and the flash butt welding unit.
Figure 2:
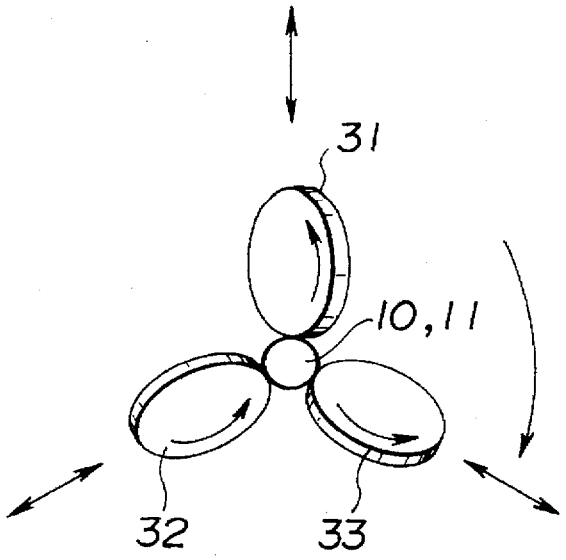
FIG. 2 is a schematic front view of the travelling grinding machine for removing burrs on the welded part of a round billet in the first aspect of the present invention.

FIG. 1 is a schematic drawing of the travelling burr-removal apparatus and the relating equipment thereof for the flash butt welding method of an example of the preferred mode of the present invention. FIG. 2 is a front schematic view of the travelling burr-removal apparatus of FIG. 1. In the figures, the flash but welder 20 is provided with the clamp 21 which fastens the preceding billet 10, the clamp 22 which fastens the succeeding billet 11, and the welding power source 23. The flash butt welding is conducted by applying a welding current between the rear end of the billet 10 and the front end of the billet 11, which billets are in a pressure welding state, via the clamps 21 and 22. The flash butt welder 20 is supported in a manner that the unit 20 is freely movable along the travelling direction of the billets 10 and 11, thus the flash butt welder 20 moves synchronously with the movement of the billets 10 and 11 when the welding operation begins. Downstream of the flash butt welder 20, the travelling grinding machine 30 for removing burrs is located. The travelling grinding machine 30 grinds a burr on the welded part, which burr was formed during the flash butt welding operation. The travelling grinding machine 30 is provided with grinders 31 through 33 which are supported in a rotatable and revolutionary state along the circumferential direction of the billet, and provided with the motors 36 and 37 which drive the grinders 31 and 32, respectively. The grinder 33 is also driven by a motor, though the driving motor is not shown in FIG. 1. The travelling grinding machine 30 is also supported in a movable state along the travelling direction of the billets 10 and 11, and the travelling grinding machine 30 moves when the grinding operation begins synchronously with the travelling billets 10 and 11.

In the apparatus shown in FIG. 1 and FIG. 2, the billets 10 and 11 came from a continuous casting unit (not shown) or a heating furnace (not shown) are separately fastened by the clamps 21 and 22 at the rear end and the front end thereof, respectively. Then the pressure welder 25 brings the rear end of the billet 10 and the front end of the billet 11 close each other. The welding current is supplied from the welding power source 23 at the state that a part of the rear and front ends contact each other to perform the flash butt welding. At that moment, the flash butt welder 20 performs the flash butt welding while travelling by itself.

Figure 3:
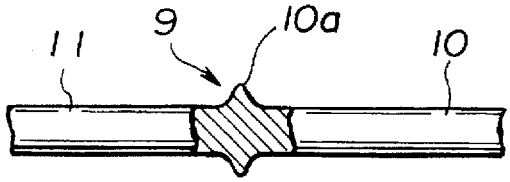
FIG. 3(*a*) shows a sectional view of a burr generated at the joint section of the billets using a flash butt welding unit.
Figure 3:
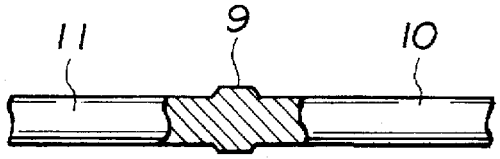

FIG. 3(*a*) is a cross sectional schematic view of the welded part 12 in a state that the rear end of the preceding billet 10 and the front end of the succeeding billet 11 are welded together by the flash butt welding method using the flash butt welder 20. As seen in the figure, the welded part 12 is uplifted on the circumferential wall owing to the upset at flash butt welding. The uplifted burr 13 is removed by grinding using the travelling burr-removal apparatus 30. FIG. 3(*b*) shows the state after removal of the burr.

When the travelling burr-removal apparatus 30 detects the welded part 12 of the billet, it starts travelling downstream and moves the constantly rotating grinders 31 through 33 toward the center of the billet using hydraulic cylinders or the like, thus presetting the billet 10. Then, the billets 10 and 11 are further transferred to downstream. When the welded part of the billet reaches beneath the grinders 31 through 33, the drive current of the drive motors 36 and 37 suddenly increases. By the sudden increase in the current, the arrival of the welded part 12 is detected, and the grinders 31 through 33 starts removing the burr 13 on the welded part 12. At that moment, the grinders 31 through 33 revolute circumferential direction of the billet (in this example, the revoluting angle is 120 deg+$\alpha$, $\alpha$ is a margin), and remove the whole burr 13 by grinding on the circumference of the billet. The revolutionary motion is conducted by, for example, supporting the whole travelling grinding machine 30 within a supporting device such as a turret ring in a rotatable state, as shown in FIG. 1.

(Preferred mode 2 of the present invention)

Figure 4:
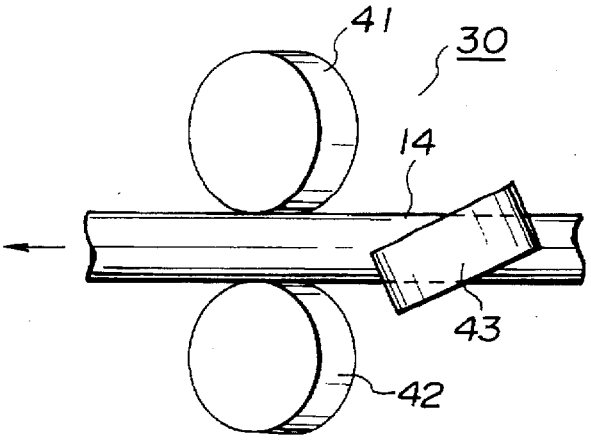
FIG. 4(*a*) shows a schematic side view of the travelling grinding machine for removing burrs on the welded part of a square billet of the first aspect of the present invention.
Figure 4:
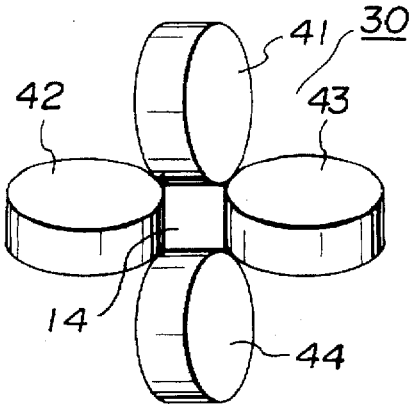

FIG. 4(*a*) and FIG. 4(*b*) are a schematic plan view and a schematic front view of another example of the travelling grinding machine of the present invention, respectively. FIG. 1 and FIG. 2 show an example of travelling burr-removal apparatus 30 for removing burr on a round billet. FIG. 4 shows an example dealing with a square billet. In FIG. 4, the grinders 41 through 44 are arranged to encircle the square billet 14, and are arranged at an tilted angle to the billet axis thereeach. The right and left grinders 41 and 42 are positioned distant from the top and bottom grinders 43 and 44 in a travelling direction of the billet to avoid mechanical interference between each pair thereof. Accordingly, in this case, the burr 13 is removed by two steps grinding operation.

(Preferred mode 3 of the present invention)

Figure 5:
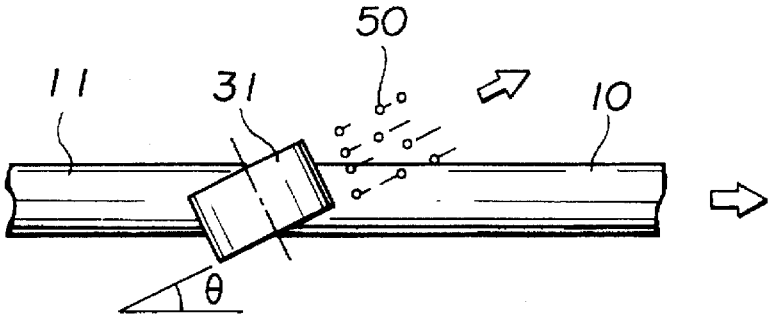
FIG. 5 is an illustrative drawing showing the scattering direction of the ground chips generated by grinding of burrs on the welded part of a billet using a travelling grinding machine.

Unless the slag generated from grinding of burr using the grinders 31 through 33 of the travelling grinding machine 30 shown in FIG. 1 is adequately removed, a long period of grinding operation cannot be sustained. To answer the requirement, the grinders 31 through 33 or the grinders 41 through 44 of the above-described travelling grinding machine of the present invention are arranged at a tilted angle against the travelling direction of the billet to ease the slag treatment. FIG. 5 illustrates the scattering direction of slag during grinding operation. As seen in the figure, since the slag 50 scatters to a direction different from the travelling direction of billets 10 and 11. Accordingly, the slag 50 is collected by installing an adequate dust collecting duct at downstream of the scattering slag. A preferred tilted angle of the grinders is in a range of from 15 to 30 degrees. The arrangement of tilted grinders has advantages of easing the slag treatment and of allowing to increase the grinding width for the width of the grinder.

According to the present invention, the burrs on the welded parts of billets joined together by flash butt welding are ground by a plurality of rotating grinders while travelling the billets and while moving the grinders synchronously with the run of the billets. Consequently, a feature of the grinding by grinders, or a feature of sustaining constant grinding state even after the grinders are abraded, maintains its effectiveness, thus assuring the burr-removal for a long period of operation. In addition, the grinders move synchronously with the run of the billet so that the on-line grinding treatment is attained without interfering the run of the billet. As a result, on-line continuous burr-removal is performed for a plurality of billets, which makes the method suitable for the continuous rolling process.

2. Example of the second aspect of the present invention (Preferred mode 1 of the present invention)

Figure 6:
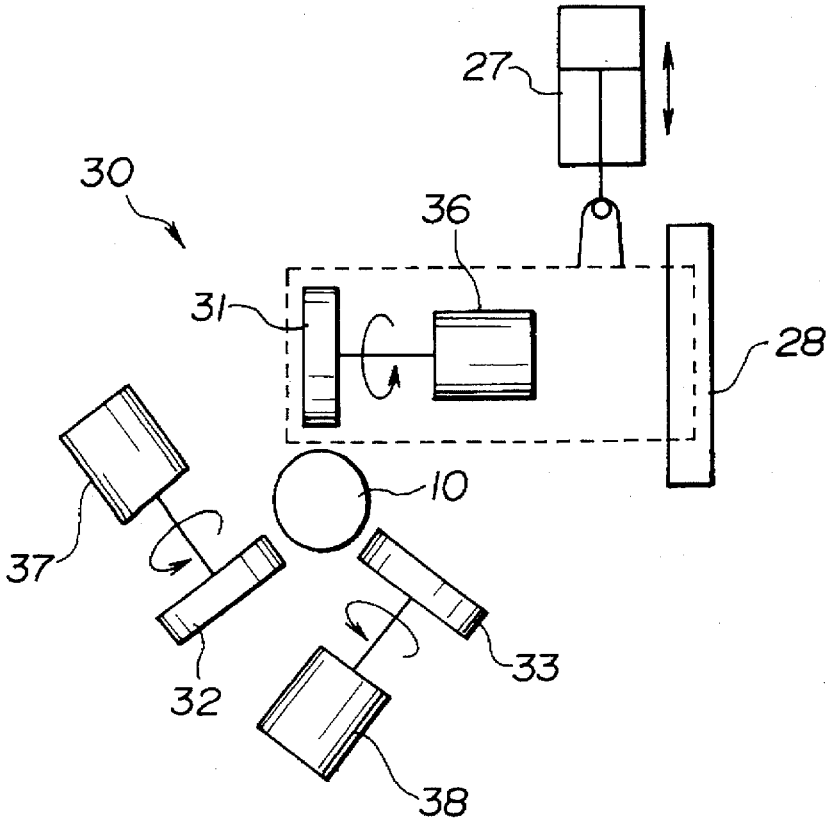
FIG. 6 is a schematic drawing of a travelling grinding machine for implementing the second aspect of the present invention.
Figure 7A:
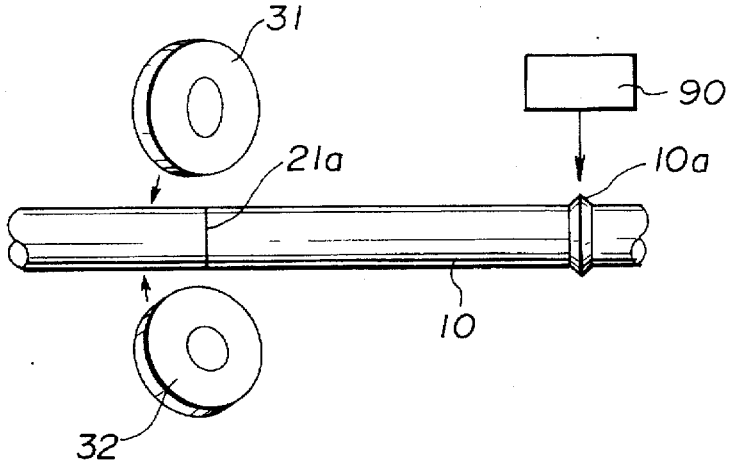
FIG. 7(*a*) shows the state that the sensor detects a welded part in the second aspect of the present invention.
Figure 7B:
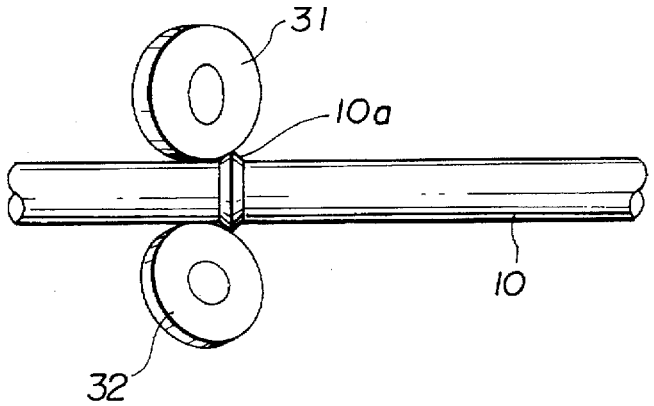

FIG. 6 is a schematic drawing of the travelling grinding machine of an example of a mode of the present invention. FIG. 7(*a*) and FIG. 7(*b*) illustrate the action of the travelling grinding machine. The travelling grinding machine 30 grinds a burr on a welded part, which was formed by the flash butt welding. The travelling grinding machine 30 is provided with the grinders 31 through 33 which are supported in a rotatable state, with the drive motors 36 through 38 to rotate the grinders 31 through 33, and with the lifting cylinder 27 and the slide guide section 28 to move each of the grinders 31 through 33 to the center of the billet. At the time of the grinding operation, the grinders 31 through 33 are locked at the preset position around the circumference of the billet. FIG. 6 and FIG. 7 show the lifting cylinder 27 and the slide guide section 28 only for the grinder 31, though similar devices of cylinder and slide guide are installed for each of the grinders 32 and 33. The travelling grinding machine 5 is supported in a movable state along the travelling direction of the billet, and, when the grinding starts, the travelling grinding machine 30 moves synchronously with the movement of the billet. The target billet in this example is a round billet, and the grinders 31 through 33 are supported in a revolutionary state along the circumference of the billet.

Figure 8:
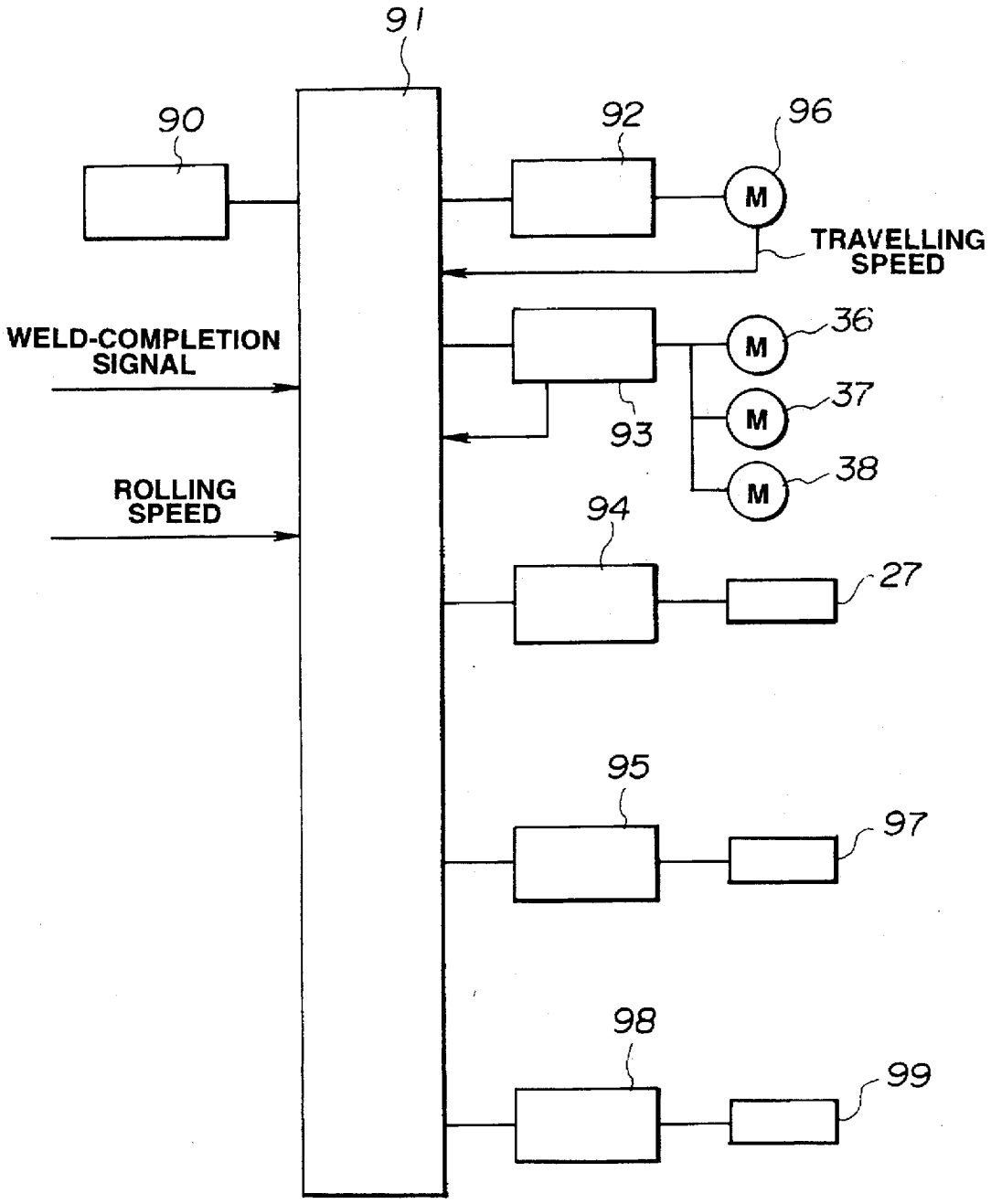
FIG. 8 is a control block diagram of the travelling grinding machine of the second aspect of the present invention.

FIG. 8 is a schematic drawing of the control system of the travelling grinding machine 5. The travelling grinding machine 30 is provided with a welded-part detection sensor 90 which detects the welded parts on the billets welded together by the flash butt welding method. The output of the sensor 90 enters the control unit 91. Based on the input signal, the control unit 91 conducts a specified computing processing, and generates the resulted control signal to the drive circuits 92 through 95. The drive circuit 92 drives the drive motor 96 which moves the body of travelling grinding machine 30 synchronously with the rolling speed during the travelling grinding operation. The drive circuit 93 drives the motors 36 through 38 which continuously rotate the grinders 31 through 33. The drive circuit 94 drives the lifting cylinder 27. The drive circuit 95 drives the drive motor 97 (not shown in FIG. 6) which revolutes the grinders 31 through 33.

The action of the travelling grinding machine 30 is described below referring to FIG. 6 through FIG. 8.

1) On receiving the weld-completion signal from the travelling flash butt welder 4, the control unit 91 drives the drive motor 96 using the drive circuit 92 to move the grinding machine 30 to upstream side. At that moment, the control unit 91 also moves the travelling flash butt welder 4 to upstream side.
2) When the welded-part detection sensor 90 detects a welded part of the billet, the control unit 91 drives the drive motor 96 in a reverse rotational direction using the drive circuit 92, and moves the grinding machine 30 to downstream side while accelerating the grinding machine up to the rolling speed. Then, the control unit 91 drives the lifting cylinder 27 using the drive circuit 94 to pre-clamp the billet. (Refer to FIG. 7(*a*).)
3) The control unit 91 detects the arrival of the welded part 10 to beneath the grinders 31 through 33. When the welded part 10*a* arrives at beneath the rotating grinders 31 through 33, (refer to FIG. 7(*b*)), the drive current of the drive motors 36 through 38 which rotate the grinders 31 through 33 shows a sudden increase. The control unit 91 detects the arrival of the welded part 10*a* by sensing the sudden increase in the drive current while entering the drive current from the drive circuit 93. The control unit 91 also tracks the position of the welded part 10*a* on the basis of the distance between the grinding point 21*a* and the welded-part detection sensor, of the moving speed of the travelling grinding machine body, and of the rolling speed.
4) The travelling grinding machine locks the lifting cylinders 27 of the grinders 31 through 33 and begins the grinding operation while travelling thereof at a synchronous speed with the rolling speed.
5) Simultaneously with the beginning of grinding, the control unit 91 drives the drive motor 96 using the drive circuit 95 and starts the turning of the grinders 31 through 33. In this example, the grinders 31 through 33 are arranged at an equal space therebetween on a circumference, so the revolution angle is 120 degrees.
6) When the revolution completed, the travelling grinding machine 30 is moved to the waiting position, and the above control action is repeated again.

(Preferred mode 2 of the present invention)

If a burr on the welded part of the billet 10 passes over the rolls in an uplifted state, the billet will be uplifted by the burr on the billet, and may derail from the V-grooved roll. Therefore, the rolls which are located between the travelling flash butt welder 4 and the travelling grinding machine 30 are necessary to escape from the billet during the welded part passes thereon.

Figure 9:
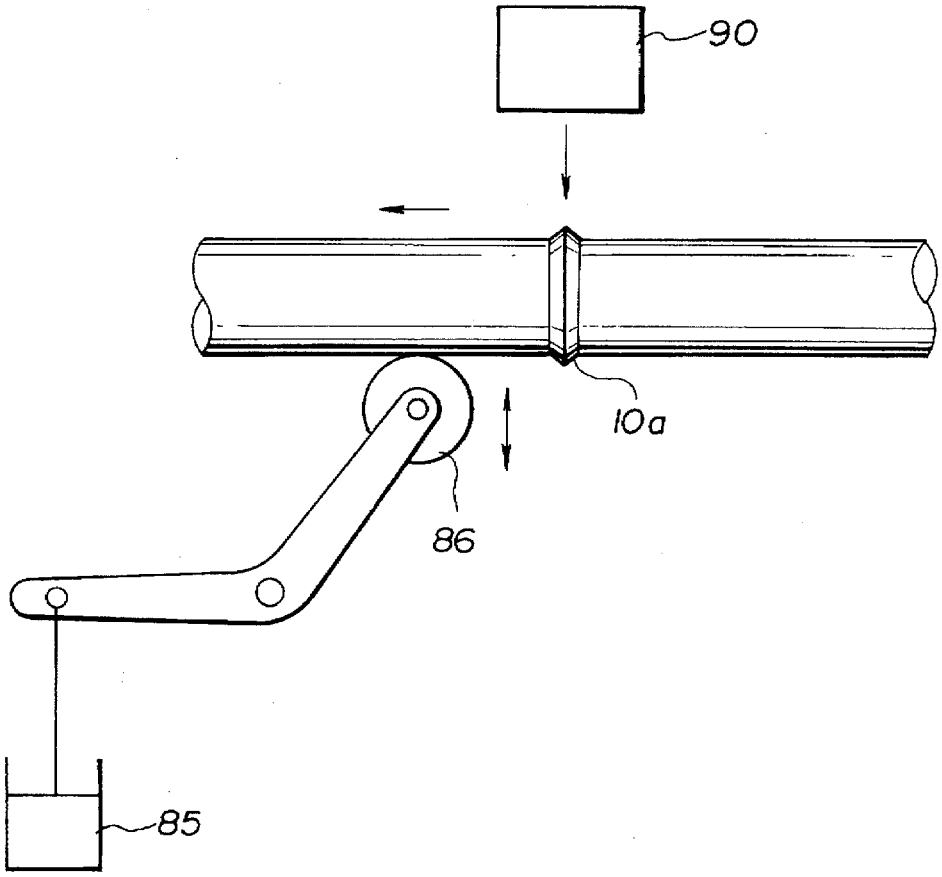
FIG. 9 is an illustrative drawing of lift mechanism of the support roll of the second aspect of the present invention.

FIG. 9 illustrates a mechanism for escaping the roll from the billet to satisfy the requirement. The roll 86 is located at downstream of the travelling flash butt welder 4 and at upstream of the grinding point 21*a*. When the welded-part detection sensor 90 detects the welded part 10*a*, the control unit 91 actuates the built-in timer to start counting the time. When the timer reaches the time-up point, then the control unit 91 drives the lifting cylinder 99 using the drive circuit 98. According to the example of FIG. 9, after the weld-part detection sensor 90 detected the welded part 10*a* and after a specified time has passed, and immediately before the welded part 10*a* passes over the roll 86, the control unit 91 drives the lifting cylinder 99 to descend the roll 86. After the welded part 10*a* passed over the roll 86, the control unit 91 ascends the roll 86. In this manner, when the welded part 10*a* passes over the roll 86, the roll concerned escapes from the billet. If that type of roll is mounted more than one, descending and ascending are repeated in the order from upstream rolls to downstream rolls.

(Preferred mode 3 of the present invention)

It is necessary to escape the rolls when a welded part of the billet passes thereover. To mount a plurality of ascending/descending rolls is not preferable from the viewpoint of investment cost and of complicated operation. Accordingly, the number of support rolls is necessary to minimize between the travelling flash but welder 4 and the travelling grinding machine 30. To do this, the present invention provides a support roll and controls separately the travelling flash butt welder 4 and the travelling grinding machine 30.

Figure 10:
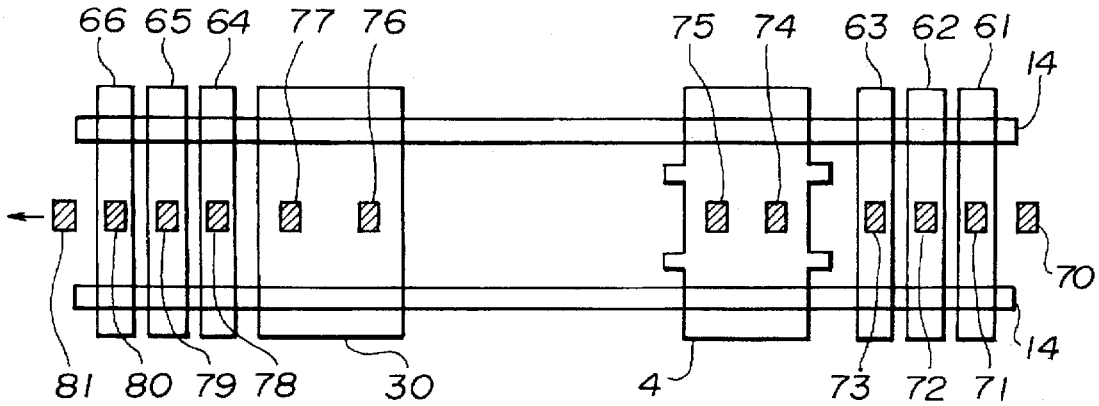
FIG. 10 shows the arrangement of the billet transfer mechanism of the second aspect of the present invention.
Figure 11A:
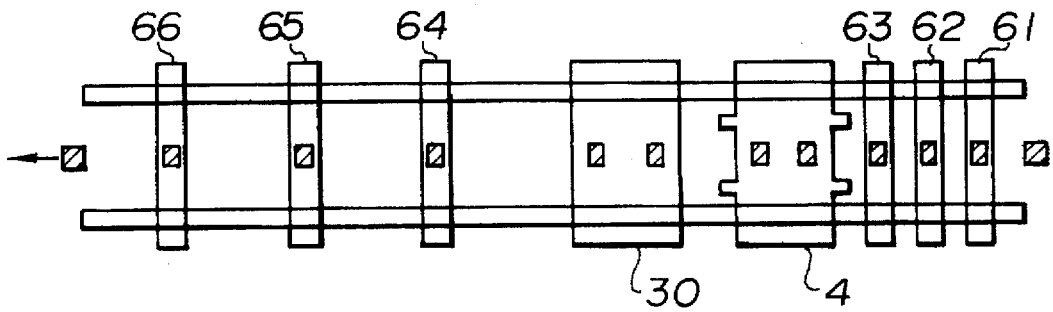
FIG. 11(*a*) shows the arrangement of vehicles and other equipment at a waiting position of the second aspect of the present invention.
Figure 11B:
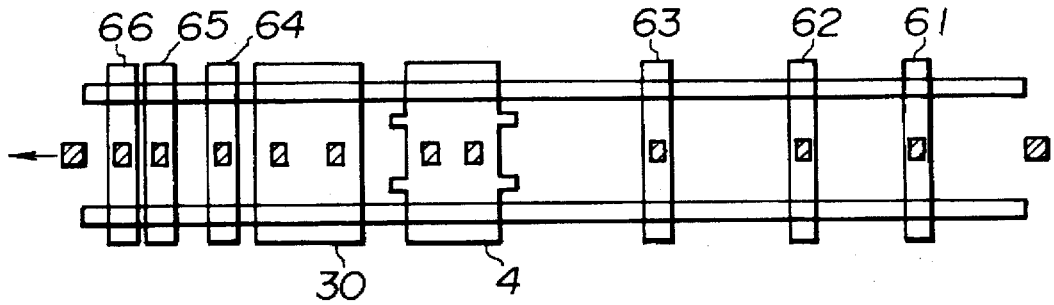
Figure 11C:
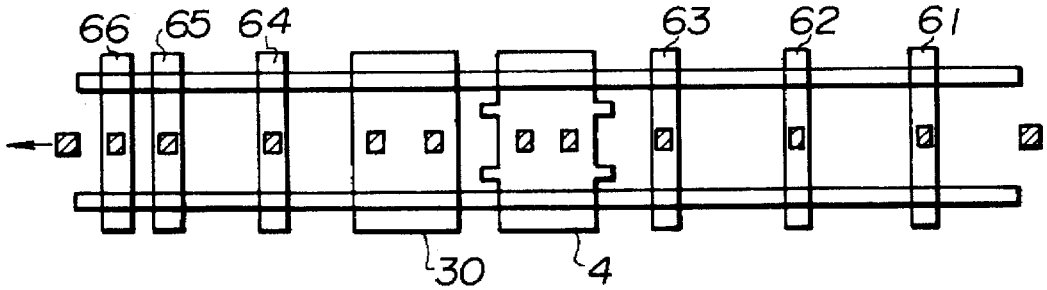
Figure 11D:
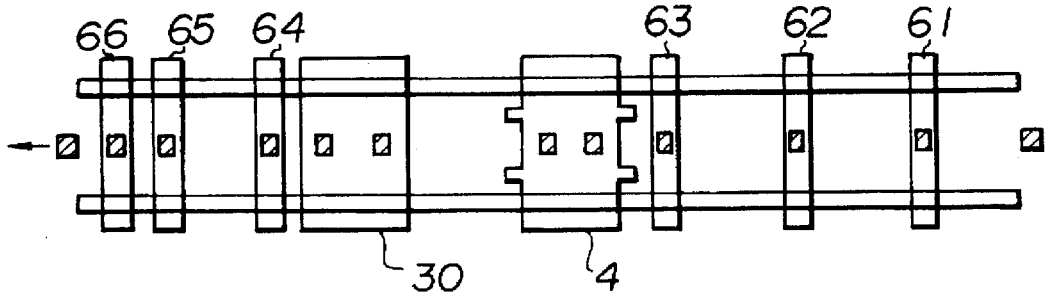

FIG. 10 shows an arrangement of transfer mechanism for the continuous rolling billets of an example of another preferred mode of the present invention. At the uppermost upstream position, the fixed roll 70 is located, and the vehicles 61 through 63 which move along the rails 14, 14, are located immediately downstream to the fixed roll 70. The vehicles 61 through 63 have the support rolls 71 through 73, respectively. The travelling flash butt welder 4 which is positioned at directly downstream of the vehicle 63 has the support rolls 74 and 75. The travelling flash butt welder 4 is successively connected with the vehicles 61 through 63 by flexible connecting means (ropes, fore example). Thus, when the travelling flash butt welder 4 moves to downstream, it moves the vehicles 61 through 63 by towing them. When the travelling flash butt welder 4 moves to upstream, it moves the vehicles 61 through 63 to upstream by pushing them.

The travelling grinding machine 5 also has the support rolls 76 and 77. The travelling flash butt welder 4 and the travelling grinding machine 30 also move on the rails 14, 14, during the operation thereof. Three vehicles 64 through 66 are located directly after the travelling grinding machine 30, which have the support rolls 78 through 80, respectively. The travelling grinding machine 30 is successively connected with the vehicles 64 through 66 by flexible connecting means (ropes, fore example). Thus, when the travelling grinding machine 30 moves to upstream, it moves the vehicles 64 through 66 upstream by towing them. When the travelling grinding machine 30 moves to downstream, it moves the vehicles 64 through 66 to downstream by pushing them. The fixing roll 81 is positioned directly after the vehicle 66.

FIG. 11 (*a*) through (*d*) illustrate the arrangement of vehicles for each control stage of the travelling flash butt welder 4 and the travelling grinding machine 30.

1) Waiting position (FIG. 11(*a*)):

First, the travelling flash butt welder 4 and the travelling grinding machine 30 are placed at the initial state, or the waiting position. At the waiting position, both the travelling flash butt welder 4 and the travelling grinding machine 30 are located at the uppermost upstream position. The distance among the support rolls 71 through 73 of the vehicles 61 through 63 which are connected to the travelling flash butt welder 4 is the shortest one. The distance among the support rolls 78 through 80 of the vehicles 64 through 66 which are connected to the welder 30 is the longest one to maintain the maximum distance for each other.

2) Weld-completion position (FIG. 11(*b*)):

When the billet detector on the travelling flash butt welder 4 detects the rear end of the succeeding billet, the travelling flash butt welder 4 begins the welding treatment while moving itself to downstream synchronously with the rolling speed. At that moment, the control unit 91 drives the drive motor 96 using the drive circuit 92 to move the travelling grinding machine 30 to downstream at a synchronous speed with the rolling speed. When the welding treatment completed, the vehicles 61 through 63 is towed by the travelling flash butt welder 4 to become the maximum distance between each of the vehicles 64 through 66 under a state of maximum stretch of the distance among each of the support rolls 71 through 73. The vehicles 64 through 66 were pushed to downstream by the travelling grinding machine 30, thus the distance among each of the support rolls 78 through 80 becomes the minimum.

3) Grinding start position (FIG. 11(*c*)):

When the welding completed, the travelling flash butt welder moves to upstream. At that moment, the control unit 91 receives a signal to indicate the weld completion from the travelling flash butt welder 4. Based on the signal, the control unit 91 moves the travelling grinding machine 30 to upstream. When the welded-part detection sensor 90 detects the arrival of the welded part of the billet, the control unit 91 stops the movement of the travelling grinding machine 30. After then, the travelling grinding machine 30 starts the grinding operation. At that moment, the distance among each of the vehicles 61 through 63 is at a slightly contracted state compared with the most stretched state, and the distance among each of the vehicles 64 through 66 is at a slightly stretched state compared with the most contracted state. Consequently, the support rolls 71 through 73 and 78 through 80 become corresponding distance to that of vehicles 61 through 66.

4) Grinding completion position (FIG. 11(*d*)):

Although the travelling flash butt welder 4 is kept stopped at the grinding start position, the travelling grinding machine 30 conducts grinding the burr on the welded part while travelling itself to downstream. Since the travelling flash butt welder 4 stops, the vehicles 61 through 63 stay at the same position as that at grinding start. Vehicles 64 through 66 are, however, at a slightly contracted state compared with that at grinding start because the travelling grinding machine 30 moves to downstream. Accordingly, the support rolls 71 through 73 and 78 through 80 of the vehicles 61 through 66 have a distance each of them corresponding to the above-described arrangement. Since the stroke of the travelling grinding machine 30 is about 1500 mm, the maximum distance between the travelling grinding machine 30 and the travelling flash butt welder 4 corresponds to the stroke. Consequently, billets are satisfactorily supported even when there is not a support roll between the travelling flash butt welder 4 and the travelling grinding machine 30. When the welding completed, the travelling flash butt welder 4 and the travelling grinding machine 30 return to the above-described waiting position, and they repeat the above-described control action.

In FIG. 10, the fixed roll 70, the support rolls 72, 75, and 79, and the fixed roll 81 are the drive rolls to assure the travelling of billets at a rolling speed. The support roll 75 of the welder 4 and the support roll 76 of the grinding machine 30 are supported in a free-lifting state and are descended when a welded part of billet passes thereover.

According to a preferred mode of the present invention described above, on-line grinding treatment is achieved because the mode comprises the steps of: detecting a welded part on billets for continuous rolling, which billets were welded to join together by a travelling welder, using the travelling grinding machine located at downstream of the welder; presetting a plurality of grinders mounted to the travelling grinding machine and continuously rotating thereof to the billet immediately after detecting the welded part while moving the travelling grinding machine synchronously with a rolling speed of the billet; detecting that the welded part of the billet arrived at a position of the grinders; and after detecting the arrival of the welded part of the billet, grinding a burr on the welded part by fixing the grinders at the preset position while travelling the travelling grinding machine with the speed of the billet rolling synchronously.

According to another preferred mode of the present invention, the burr is effectively removed for total circumference of the billet because the burr on the welded part is ground using the grinders arranged on a circumference of the round billet at an equal distance therebetween while turning the grinders.

According to a further preferred mode of the present invention, the welded part of the billet is avoided to pass over the support rolls while contacting each other owing to a control means of the support rolls including a step of descending the support roll located at directly downstream of the detection point after detecting the welded part of the billet, and ascending thereof after a specified period of time.

According to still another preferred mode of the present invention, the billets are adequately supported without placing support roll between the travelling welder and the travelling grinding machine because the travelling welder is in a move-controlled state responding to the weld completion point and the grinding point to minimize the distance between the travelling welder and the travelling grinding machine.

3. Example of the third aspect of the present invention (Preferred mode of the present invention)

Figure 12:
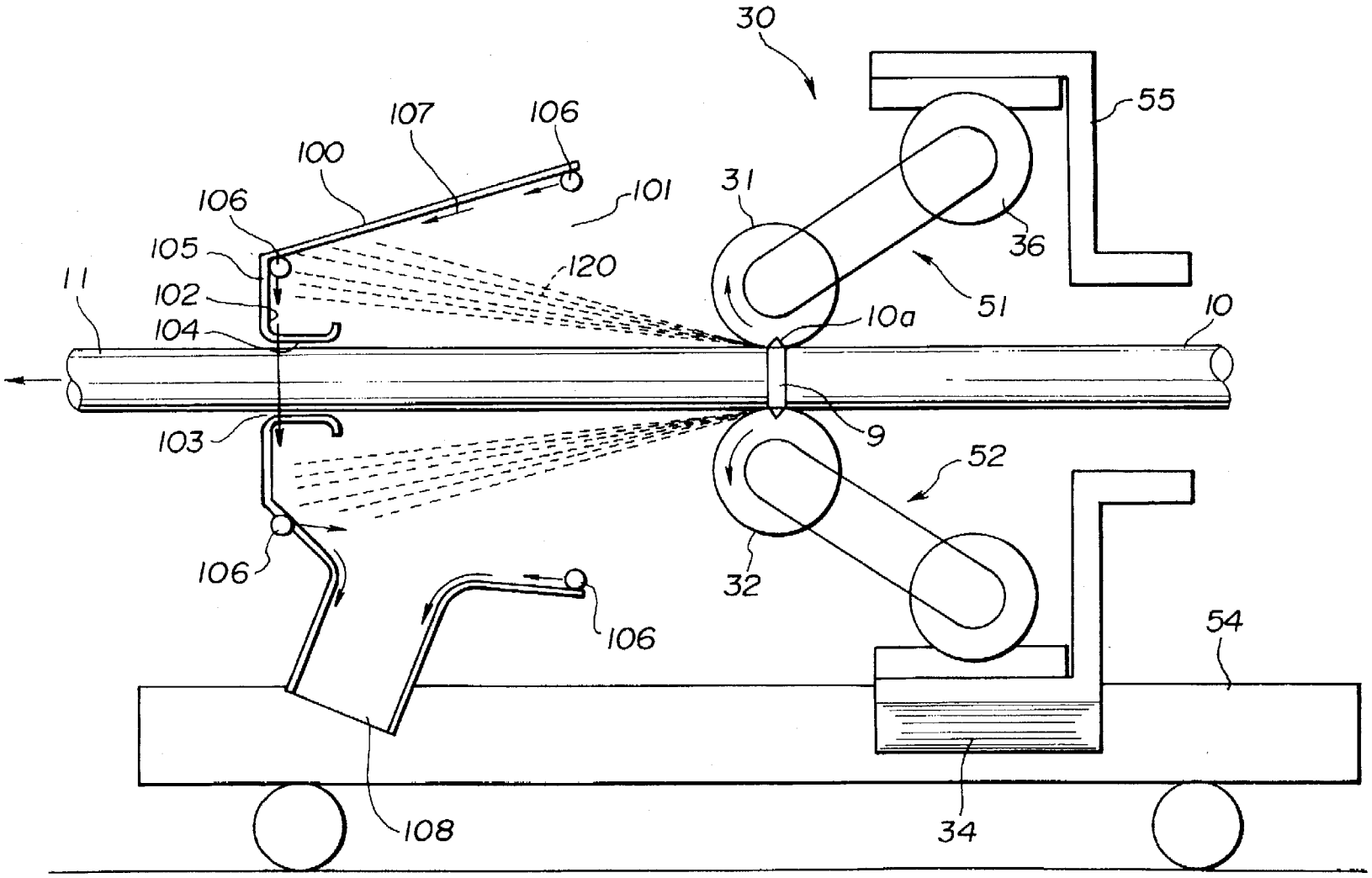
FIG. 12 is a longitudinal cross sectional view of the hood for implementing the means for treating the ground slag of the third aspect of the present invention.
Figure 13:
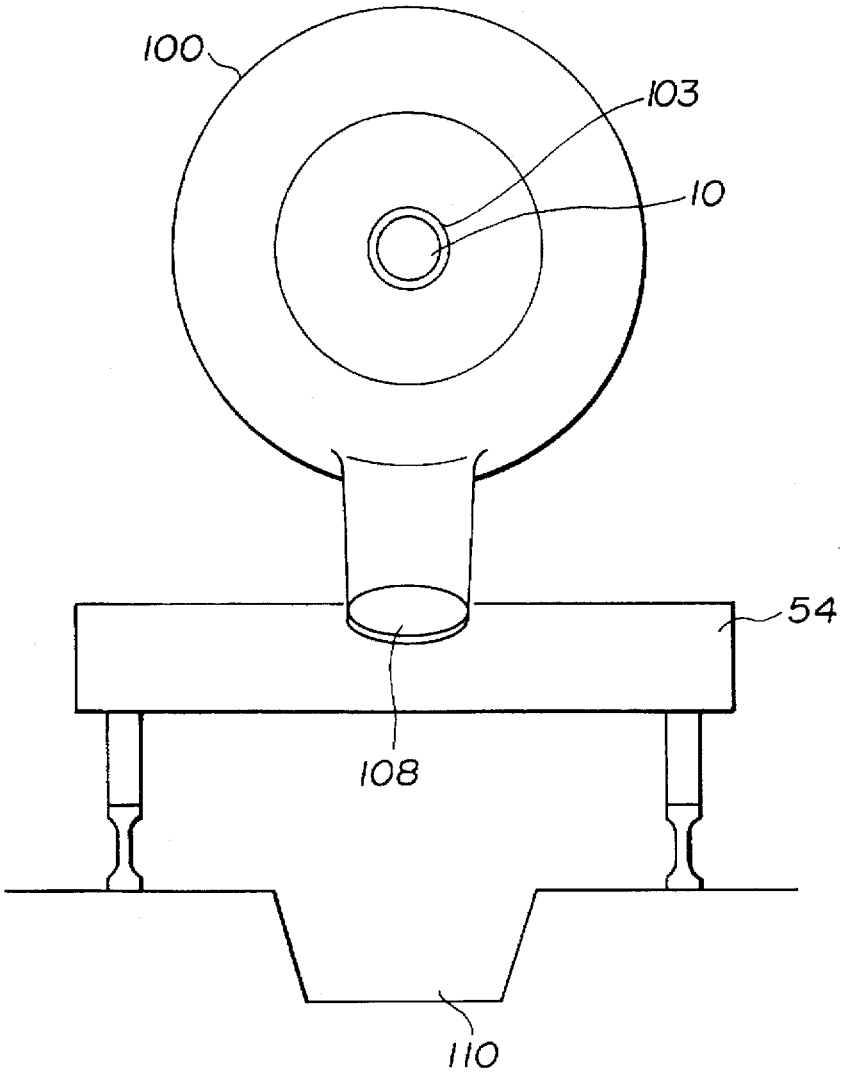
FIG. 13 is a front view of the hood for implementing the means for treating the ground slag of the third aspect of the present invention.

FIG. 12 is a schematic drawing illustrating a continuous treatment of ground slag of the present invention. FIG. 13 is a front view of the hood.

In these figures, the continuous billet 11 moves to the arrow direction. The flash butt welder (not shown) located at upstream side conducts continuous flash butt welding. Reference numeral 9 denotes the welded part 9, and reference numeral 10*a* denotes the burr on the welded part. The grinding machine 30 which travels along the billet moving direction has a plurality of grinding devices 51 which has the grinders 31 and 32 to remove the burr 10*a* while revoluting along the circumference of the welded part 9. The turret ring 55 is supported by the roller 34 on the travelling body 54 in free-rotational state, which turret ring 55 has the motor 36 of the grinding device 51. The ground slag 120 generates during the grinding of the burr 10*a*, which slag 120 scatters to downstream to a specified direction within a specified range. The grinders 31 and 32 come close to or apart from the billet 1 by a lifting means or a swing means (both means are not shown).

The hood 100 is located on the travelling body 54 while facing the scattering direction of the ground slag 120. The shape of the hood 100 has a wide front opening 101 around the billet 1, and a gentle slope inner face from the edge of the opening 101 to connect the vertical impinging face 102. The impinging face 102 receives most part of the ground slag 120. In addition, the impinging face 102 has an opening 103 through which the billet 1 passes. The opening 103 is provided with a billet cover 104 having an adequate length to cover the billet. The front edge of the billet cover 104 has a rise 25 which rises toward outside therefrom.

Spray nozzles 106 are mounted at adequate positions in the hood 100 to cover the whole inside surface of the hood 100 with flowing water film 107. A discharge opening 108 is opened at bottom of the hood 100.

The burr-removing grinding is conducted while the grinding machine 30 travels synchronously with the moving speed of the billet 11. The spray nozzles 106 in the hood 100 sprays water in advance to cover the whole inner face of the hood 100 with the flowing water film 107. The grinders 31 and 32 grind the burr 10*a* on the welded part 9 while rotating to the arrow direction and while revoluting around the circumference of the billet 11. The ground slag 120 generated by the grinding scatters to downstream in a cone shape pattern as shown in FIG. 12. Since the hood 100 is located facing the scattering direction of the ground slag 120, the ground slag C scattering in a conical pattern enters the opening 101 and collides against the impinging face 102, which slag is immediately cooled by the flowing water film 107 and is discharged along with the water film 107 through the bottom opening 108. The discharge opening 108 opens at above the drain channel 110, for example, so the slag can be accumulated at a specified place via the drain channel 110.

The billet 11 moves through the opening 103 on the impinging face 102. The opening 103 is provided with the billet cover 104, and the front edge of the cover 104 forms a rise 105, so the flowing water film 107 does not contact with the billet 11 but the film flows down along the billet cover 104 while going around the billet 11. As a result, the temperature of the billet 11 does not reduce, and heat loss is prevented.

In this manner, the burrs 10*a* of the welded parts 9 on successively arriving billets are ground while collecting the generated ground slag 120 by the hood 100 having a specially designed shape and structure and while removing the collected slag 120 along with the flowing water film 107 on the inner face of the hood. Consequently, the ground slag is continuously treated without accumulating thereof.

Figure 14:
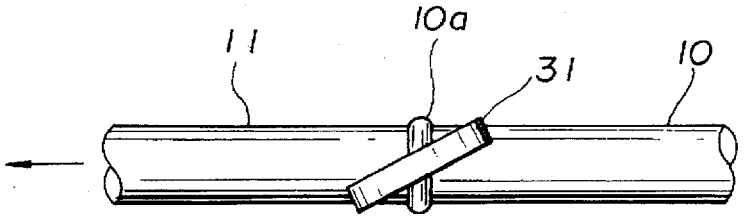
FIG. 14 shows an example of arrangement of grinders for a round billet.

FIG. 2 and FIG. 14 show an example of arrangement of a grinder 31 against the round billet 10. FIG. 2 is a front view, and FIG. 14 is a top view. As shown in these figures, it is preferable to place the grinder 31 at a tilted angle against the axis of the round billet 10. With that type of placing, the scattering direction of the ground slag is assured to a obliqe direction, and the grinding width to the welded part 9 is widened.

Figure 15A:
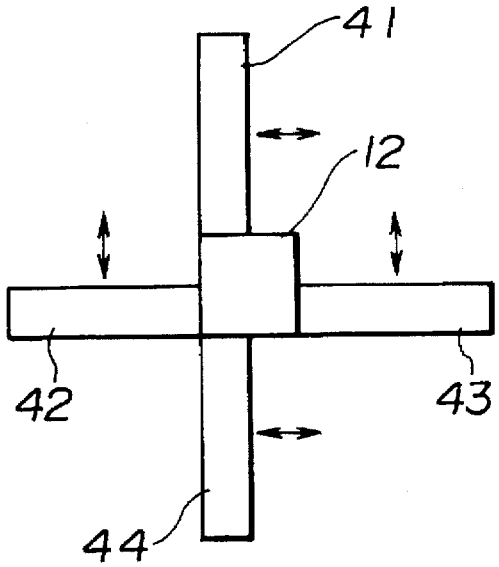
FIG. 15(*a*) is a front view of the grinders for a square billet.
Figure 15B:
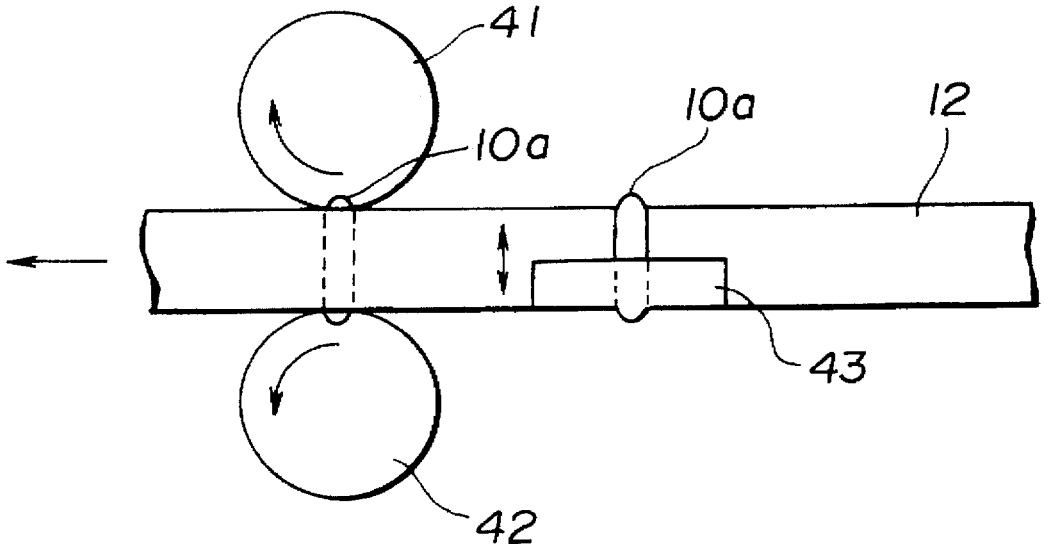

FIG. 15(*a*) and FIG. 15(*b*) illustrate an example of the arrangement of grinders 41 through 44 against the billet 12. FIG. 15(*a*) is a front view, and FIG. 15(*b*) is a side view. In that case, a preferable arrangement of the grinders 41 through 44 is to position each pair thereof along the axial direction of the square billet 12 separating each pair of them. Generally the length of a side of the square billet 11 will be larger than the width of a grinder, so the grinders 41 through 44 are constructed in a movable state along the direction of side length during the grinding operation. The grinding is performed by two-steps: right and left sides, and top and bottom sides. With the parallel arrangement of the grinders 41 through 44 to the axial line of the square billet 12, the ground slag generated from the upstream grinders 41 through 44 is prevented from hitting the grinding machine at downstream. The scattering direction of the ground slag is oblique angle to the axial line of the square billet 12.

As described above, the continuous treatment method of ground slag of the present invention for removing burr on the welded part of billet using the grinding with grinders comprises the steps of: regulating the direction of scattering ground slag in a specified downstream direction; collecting the ground slag using the hood covered with a flowing water film inside thereof; and flowing down the collected slag along with the flowing water film. Therefore, the method of the present invention allows the continuous treatment of ground slag without accumulating thereof, thus realizes the treatment of ground slag, which was an issue in prior art. As a result, the effectiveness of the grinding with grinders in the continuous rolling process is maximized.

4. Example of the third aspect of the present invention (Preferred mode of the present invention)

Figure 16:
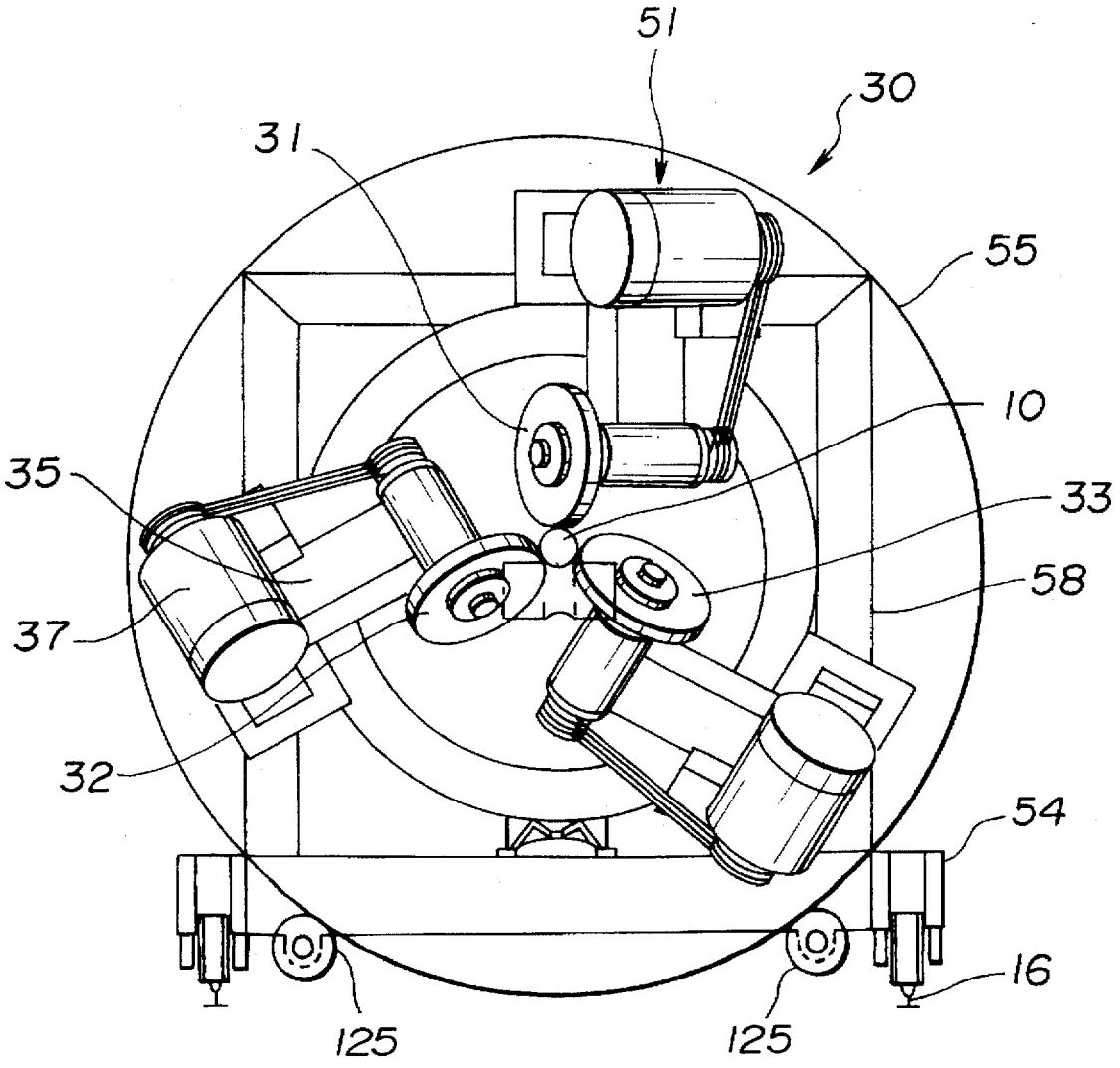
FIG. 16 is a front view of the travelling grinding machine of the fourth aspect of the present invention.
Figure 17:
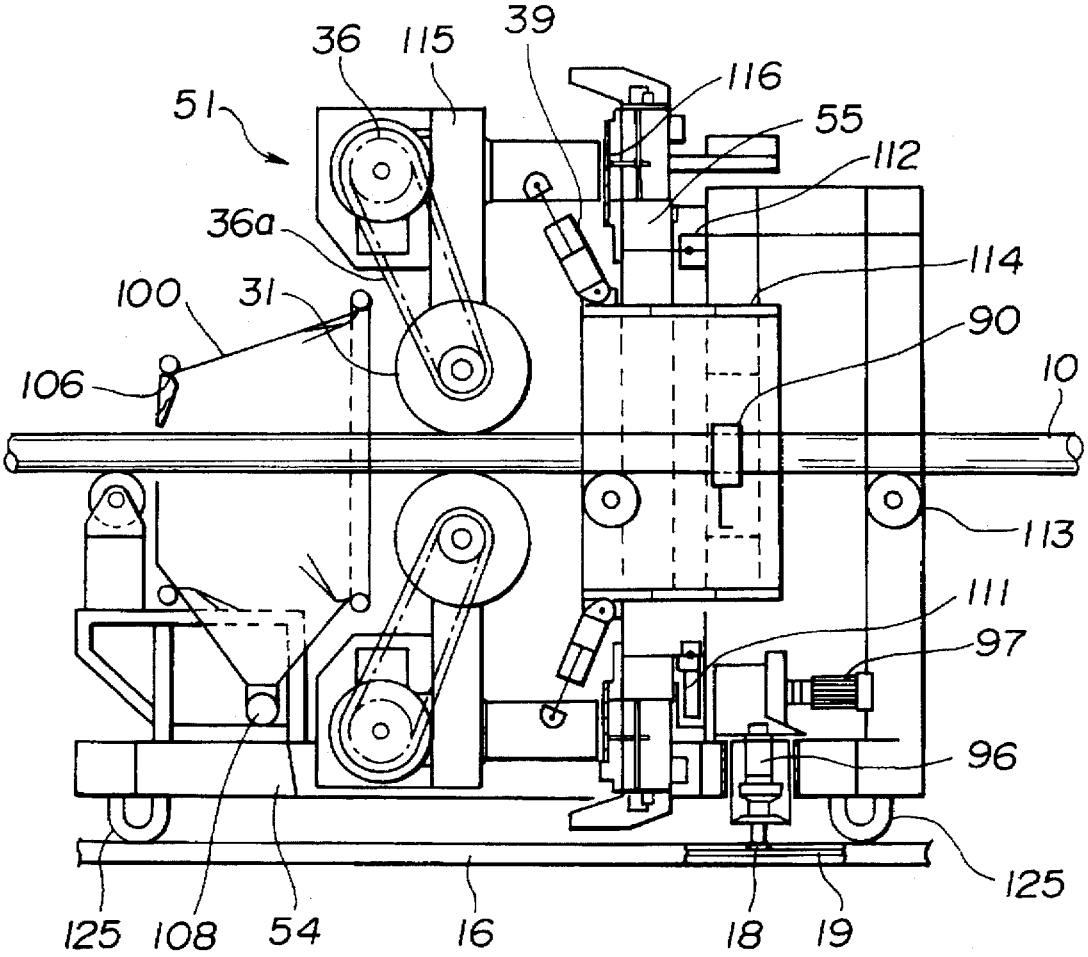
FIG. 17 is a side view of the travelling grinding machine of the fourth aspect of the present invention.

FIG. 16 is a front view of an example of the travelling burr-removal apparatus of the present invention, and FIG. 17 is a side view of the unit.

Figure 18:
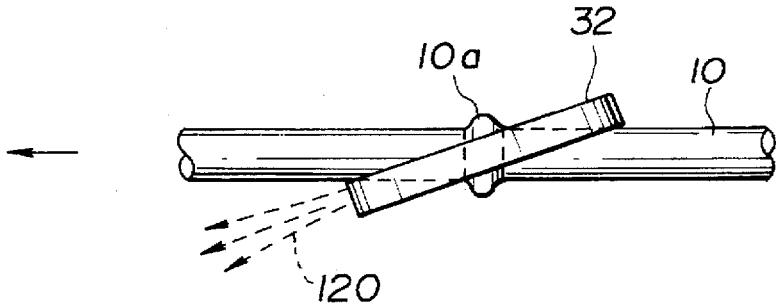
FIG. 18 is an illustrative drawing showing the state of setting the grinders.

The travelling burr-removal apparatus 30 for removing burr comprises the travelling body 11 which has the turret ring 55 thereon. The turret ring 55 is provided with three grinding devices 51 which are separately driven to rotate and are movable to a radial direction of the turret ring 55. Each of the grinders 31 through 34 is tilted at a specified angle against the center axis of the round billet 10 as shown in FIG. 18. With the tilted angle, a grinder having relatively thin thickness can grind the burr 10*a* on the welded part 9 to a wide width thereon. Since the scattering direction of generated slag 120 is a oblique angle against the center axis of the round billet 10, the separation and collection of the slag 120 is easily performed.

The travelling body 54 travels on the rails 16 laid along the billet moving direction at a specified stroke. The servomotor 96 for driving travelling is actuated by mating the pinion 18 on the motor output shaft with the rack on the side of the rails 16.

The turret ring 55 is structured by frames, and is supported at its bottom by the supporting rollers 125 in a rotatable state on the travelling body 54. The rear side of the turret ring 55 is supported by the longitudinal frame 58 which stands on the travelling body 54. The longitudinal frame 58 is provided with the turret drive motor 97. The turret ring 55 rotates around the center axis of the round billet 10 by mating the pinion 111 mounted to the output shaft of the turret drive motor 97 with the ring gear 112 at the rear side of the turret ring 55. The billets 10 are continuously joined together by a preceding travelling flash butt welder (not shown).

A plurality of grinding devices 51 each of which is separately driven are mounted on the support 115. Each support 115 is supported at the front side of the turret ring 55 via the slide table 116 in a free-sliding state. The slide table 116 is connected with the turret ring 55 by a hydraulic cylinder 39 for moving. Thus, by moving the grinders 31 through 33 to the radial direction of the turret ring 55, the grinder devices 51 are configured in a concentric pattern around the center axis of the round billet 10 allowing displacing thereof. The grinder 31 is driven to rotate by the grinder drive motor 36 mounted on the support 115 via the belt 36*a*.

A bead sensor 90 is located at upstream of the grinder 31 to detect the billet welded part 9. A dust collection hood 100 is located at downstream of the grinder 31, and a plurality of water spray nozzles 106 on inside face of the hood 100. Owing to the hood 100 and the water spray from the water spray nozzles 106, the spark of ground slag generated during the burr removing operation is cooled, and the ground slag are collected. Thus the collected slag is discharged through the drain pipe 108 into drain channel or the like. The support roll 113 of the continuous billet 10 descends when the welded part 9 passes thereover. The lifting means of the support roll 113 is not shown. The reference numeral 114 denotes the heat isolation hood.

Figure 19:
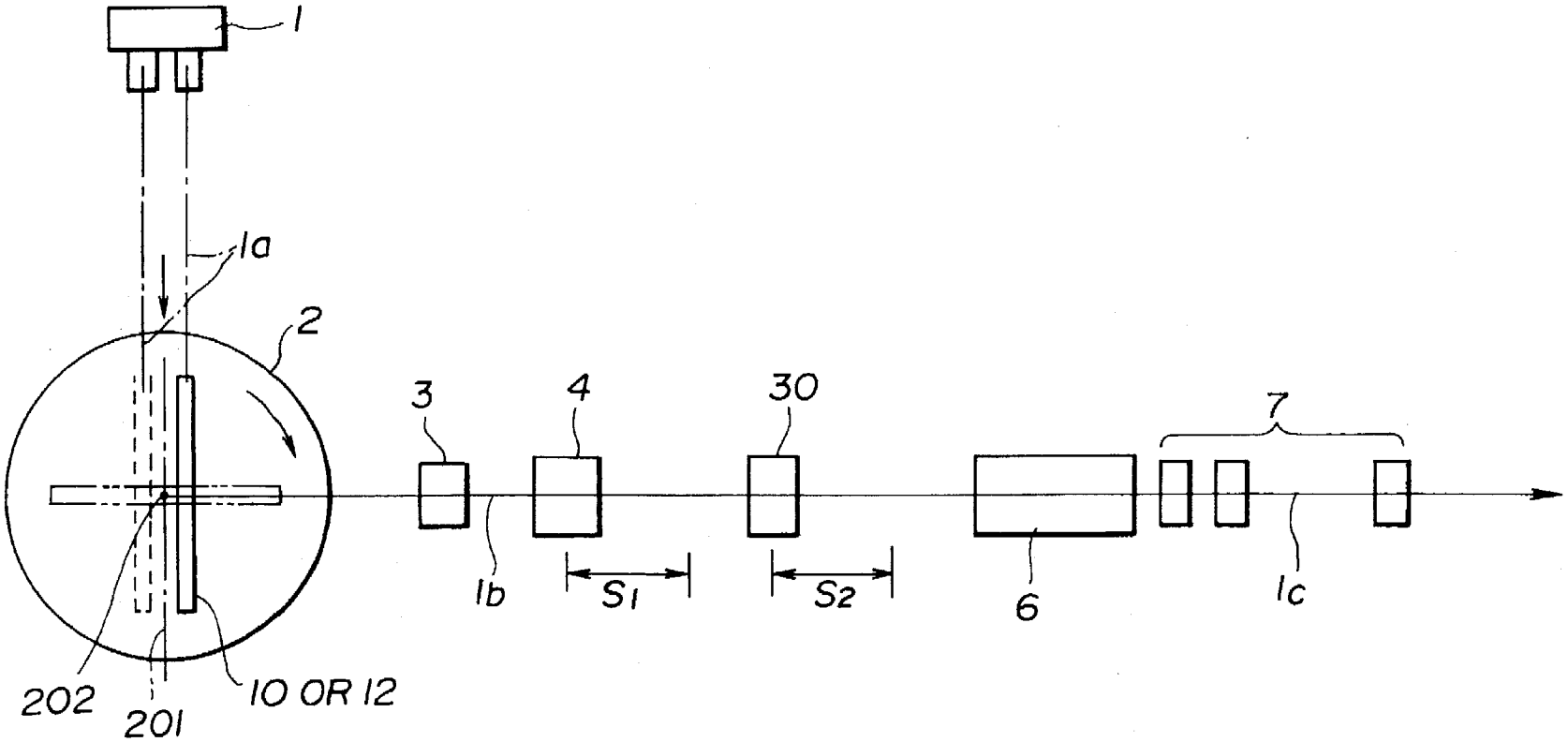
FIG. 19 is a schematic drawing of an HDR type continuous rolling unit for a round billet.

The grinding machine 30 for removing burr as structured described above is installed as a part of the continuous rolling facility for round billet, for example, as shown in FIG. 19. FIG. 19 shows a schematic drawing of a continuous rolling mill of HDR (Hot Direct Rolling) type. The continuous casting machine 1 in the figure is, in this example, a continuous casting machine of two strand type. The turn table 2 is installed at the base end side of the connection line 1*b* of the round billet 10, which turn table 2 shifts the billet 10 thereon while turning thereof onto the center line 201. The reference numeral 3 is the de-scaling unit to remove the scale by, for example, injecting high pressure water against thereof. The reference numeral 4 is the travelling flash butt welder which travels at a specified stroke S1. Succeeding to the welder 4, the travelling grinding machine 30 of the present invention is installed. The reference numeral 6 is the induction heating unit to heat the continuous billet after removing burr to a specified temperature. The reference numeral 7 is a series of rolling mills comprising a plurality of rolling mill stands to structure the rolling line. The reference numeral 1*a* denotes the casting line, and 1*c* denotes the rolling line. The joining line 1*b* of the billet 10 and the rolling line 1*c* are connected in series. The reference number 202 is the rotational center of the turn table 2, which center fits the joining line 1*b*.

The action of travelling grinding machine 30 is described below along with the description on the action of the above-described HDR continuous rolling facility.

The round billets 10 which were continuously cast by the continuous casting machine 1 are transferred onto the turn table by one at the single turn thereof, and the billet 10 is shifted to match the center line 201 of the turn table 2 and to match the joining line 1*b* during the single turn thereof. Then the round billet 10 is directly fed to the joining line 1*b* one by one. The directly supplied billets 10 are subjected to de-scaling and are successively welded at the front end of the preceding billet with the rear end of the succeeding one while travelling thereof using the flash butt welding method. The state of billet welding is shown in FIG. 3(*a*), which indicates that the burr 10*a* rose above the circumference of the billet. The height H of the burr 10*a* is normally 7 to 15 mm. Accordingly, the rolling of billet while leaving such a burr 10*a* nontreated results in a defect on the product. For removing the burr 10*a*, the grinders are used in the travelling grinding machine 30 to remove the burrs quickly and successively.

That is, when the sensor 90 detects the position of the welded part 9, the travelling grinding machine 30 begins to move to downstream, and the grinders 31 of the grinding device 51 begin to rotate, and further the hydraulic cylinder 39 moves the grinder device 51 toward the center of the billet to preset the grinding depth. When the continuous billet 1 further moves to downstream and when the billet welded part 9 arrives at directly beneath the grinder 31, the driving current of the grinder drive motor 36 shows a sudden increase in current, which notifies the arrival of the welded part 9. When the welded part 9 arrives at directly beneath the grinder 31, the rotating grinder 31 is fixed at the preset position, and the grinder device 51 is revoluted around the continuous billet 10 using the turret ring 55 to remove the burr 10*a* on the whole circumference of the continuous billet 10. Since the grinder 31 is set at a tilted angle against the billet center axis and the grinder 31 revolutes around the continuous billet 10, even a thin grinder 31 can remove the burr 10*a* at a wide width. Also since the scattering direction of the slag 120 is able to regulate in a oblique angle as shown in the figure, the slag 4 is easily collected. The burr-removal apparatus 30 conducts the removal of burr during the travelling period of stroke S2 as shown in FIG. 18. After completing the burr removal, the burr-removal apparatus 30 returns to the original position, and the successive burr removing action against the welded part 9 is performed following the above-described procedure. In this manner, the burr 10*a* of each welded part 9 is successively removed. The state after the completion of the burr removal is shown in FIG. 3(*b*). Since the welded part 9 is also rolled, the burr removal is not required to accurately finish but left at a rough finish.

During the burr-grinding operation, a lot of slag 120 generates. A dust collection hood 100 is mounted at front side of the grinder 31, so the water spray through the water spray nozzles attached on the inside face of the hood allows to collect the slag 120 while cooling thereof. Furthermore, the slag 120 is discharged to outside through the drain pipe 108 so that the slag 120 is not emitted to the peripheral area of the apparatus 30.

If the size of billet 1 changes, a plurality of grinders 31 through 33 are capable of displacing, so a quick response to the size change is applicable without adding special action.

As described above, the travelling burr-removal apparatus of the present invention for a process of continuous rolling of the direct feed billets which were continuously cast comprises the steps of removing the burrs on the welded parts of the round billets which were continuously welded by the flash butt welding method using the grinders while travelling the billets. As a result, the on-line burr removal is conducted successively at a high productivity, at a short burr-removing time, for a long period of application.

Since the grinders are set at a oblique angle against the center axis of the billet, the burr-removal is conducted ones a wide range of burrs, while regulating the scattering direction of slag, thus easing the separation and collection of scattered slag.

Owing to the dust collection hood equipped with the water spray nozzles inside thereof, the slag can be separated and collected without emitting the slag during the burr removing operation.

5. Example of the fifth aspect of the present invention (Preferred mode of the present invention)

Figure 20:
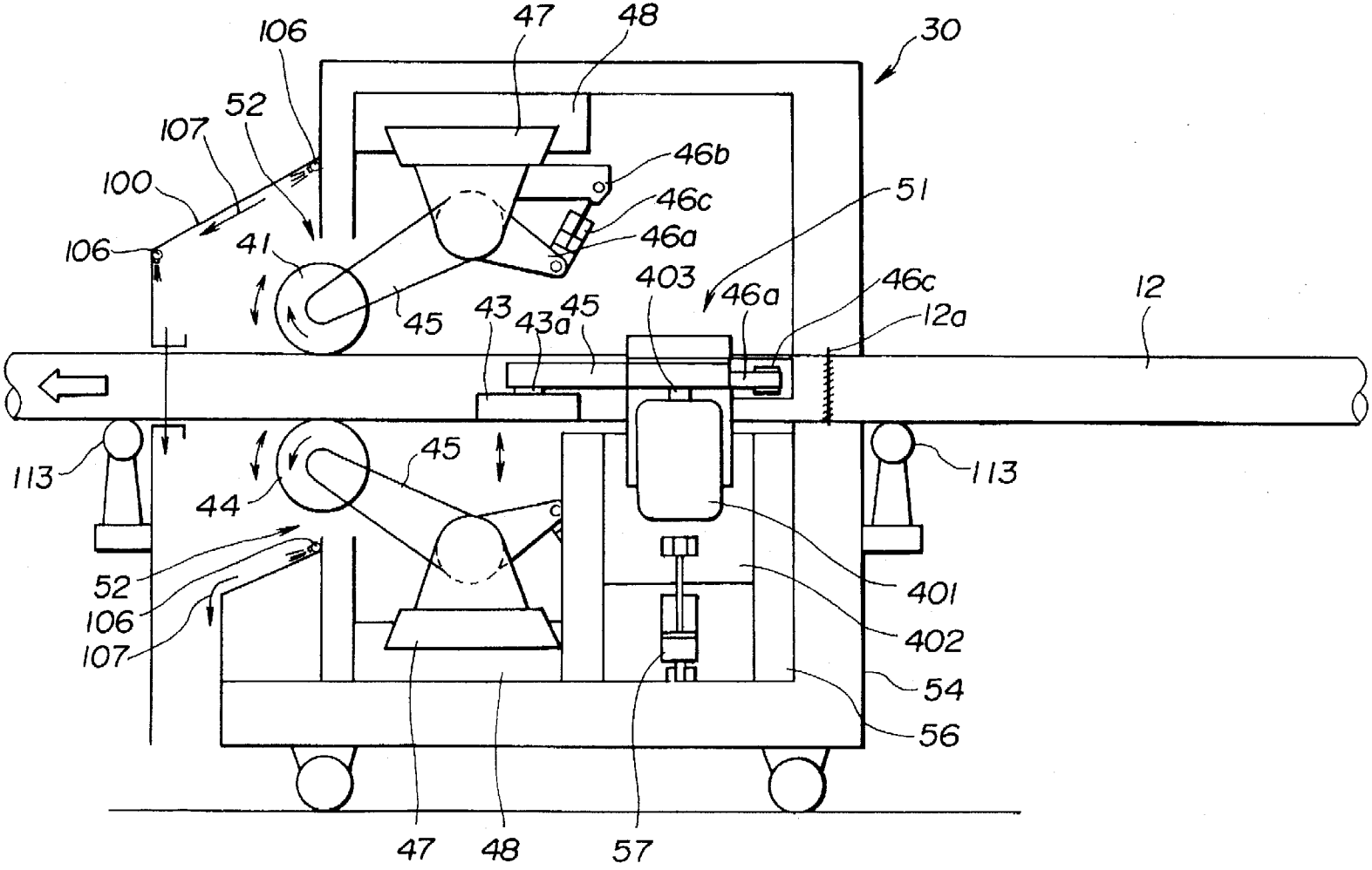
FIG. 20 is a side view of the travelling grinding machine of the fifth aspect of the present invention.

FIG. 20 is a side view of an example of the structure of burr-removal apparatus of the present invention. FIG. 4(*a*) and FIG. 4(*b*) are front view of the grinder arrangement against the square billet.

The burr-removal apparatus 30 is provided with two pairs of grinding devices 51 and 52, total four devices, on the travelling body 11. Among them, a pair of the grinding devices is located at upstream to grind the right and left sides of the welded part 12*a* of the square billet 12, and the other pair is located at downstream to grind the top and bottom faces of the welded part 12*a* of the square billet 12. Each of the grinders 41 through 44 is positioned parallel to the longitudinal direction of the square billet 12. That is, the rotational axis 43*a* of the grinder is right angle to the axis of the square billet 12. The grinder 43 is driven by the motor 401 to rotate to the arrow direction so as the ground slag scatters to downstream direction.

Each motor 401 is mounted on the slide base 402. In the grinding device 51 at upstream, the slide base 402 is vertically guided using the vertical base holder 56. In the grinding device 52 at downstream, the slide base 402 is horizontally guided using the horizontal base holder 48. For sliding the slide base 47, the sliding cylinder 57 connects the base holders 56 and 48. The sliding cylinder that connects the base holder 48 with the slide base 47 is not shown. With the configuration, the grinders 41 through 44 are capable of sliding along the longitudinal direction of a side of the square billet 12.

Each of the grinders 41 through 44 is rotated by a belt transmission mechanism which is not shown. The casing 45 containing the belt transmission mechanism has the arm 46*a*. The front end of the arm 46*a* and the front end of the arm 46*a* which protrude from the motor casing are connected by a swing cylinder 460 to enabling the swing of the grinder 43 around the motor shaft 403. Owing to the configuration, the grinder 43 is able to come close to or separate from the square billet 12.

The dust collecting hood 100 is mounted at downstream of the grinding devices 51 and 52 to collect the ground slag and to wash the slag down to the bottom of the hood. The dust collection hood 100 is equipped with the water spray nozzles 106 inside thereof to form a flowing water film on the inner face thereof. Since the slag scatters to a specified direction as described before, the dust collecting hood 100 accepts the scattered slag, and wash the collected slag down along the flowing water film 107 on the inner face of the hood. The support roller 113 for the square billet 12 descends during the welded part 12*a* passing thereover by a lifting means (not shown).

The grinding machine 30 for removing burr as structured described above is installed as a part of the continuous rolling facilityu for square billet, for example, as shown in FIG. 19. FIG. 19 shows a schematic drawing of a continuous rolling mill of HDR (Hot Direct Rolling) type. The continuous casting machine 1 in the figure is, in this example, a continuous casting machine of two strand type. The turn table 2 is installed at the base end side of the joining line 1*b* of the square billet 12, which turn table 2 shifts the billet 12 thereon while turning thereof onto the center line 201. The reference numeral 3 is the de-scaling apparatus to remove the scale on the billet 12 by, for example, injecting high pressure water against thereof. The reference numeral 4 is the travelling flash butt welder which travels at a specified stroke S1. Succeeding to the welder 4, the travelling grinding machine 30 of the present invention is installed. The reference numeral 6 is the induction heating unit to heat the continuous billet after removing burr to a specified temperature. The reference numeral 7 is a series of rolling mills comprising a plurality of rolling mill stands to structure the rolling line. The reference numeral 1*a* denotes the casting line, and 1*c* denotes the rolling line. The joining line 1*b* of the billet 10 and the rolling line 1*c* are connected in series. The reference numeral 202 is the rotational center of the turn table 2, which center fits the joining line 1*b*.

The action of travelling grinding machine 30 is described below along with the description on the action of the above-described HDR continuous rolling facility.

The square billets 12 which were continuously cast by the continuous casting machine 1 are transferred onto the turn table 2 by one at the single turn thereof, and the billet 12 is shifted to match the center line 201 of the turn table 2 and to match the joining line 1*b* during the single turn thereof. Then the square billet 12 is directly fed to the joining line 1*b* one by one. The directly supplied billets 12 are subjected to de-scaling at the descaling apparatus 3 applying, for example, the injection of high pressure water, and are successively welded at the front end of the preceding billet with the rear end of the succeeding one while travelling thereof using the flash butt welding method. The state of billet welding is shown in FIG. 3(*a*), which indicates that the burr 10*a* rose above the circumference of the billet. The height H of the burr 12*a* is normally 7 to 15 mm.

Accordingly, while leaving such a burr 12*a* nontreated, the rolling of billet results in a defect on the product. For removing the burr 12*a*, the grinders are used in the travelling grinding machine 30 to remove the burrs quickly and successively.

That is, when a sensor (not shown) detects the position of the welded part 12*a*, the travelling grinding machine 30 starts to move to downstream, and the grinders 43 and 44 of the grinding device 51 starts to rotate. Firstly, the grinder device 51 at upstream moves the grinder 43 toward the center of the billet to preset the grinding depth using the swing cylinder 46*c*. When the continuous square billet 12 further moves to downstream and when the billet welded part 12*a* arrives at directly beneath the grinder 43, the driving current of the grinder drive motor 401 shows a sudden increase, which sudden increase in current notifies the arrival of the welded part 12*a*. When the welded part 12*a* arrives at directly beneath the grinder 43, the rotating grinder 43 is fixed at the preset position. When the length of a side of the square billet 12 is longer than the width of the grinder, the grinding device 51 is ascended or descended using the sliding cylinder 57 to grind the right and left sides of the billet welded part 12*a*, so the whole burr 12*a* on the right and left sides is ground to remove. After removing the right and left side burr, the grinder 41 stops its rotation, and leaves from the grinding position to go back to the original position by the action of the swing cylinder 460, and further returns to the original position by the action of the sliding cylinder 57.

When the square billet 12 is transferred and arrives at the grinding device 52 at downstream, the grinding device 52 performs similar function with that of the grinding device 51. Thus the grinder 44 of the grinding device 52 grinds the burr on top and bottom sides of the billet welded part 12*a* to remove the burr. In this manner, the billet welded part 12*a* is firstly ground on right and left sides, then on top and bottom side to remove the burr. The necessary time for grinding in each stage is about 5 to 10 sec, which timing is sufficient to satisfy the time cycle of the continuous rolling of square billets.

The travelling grinding machine 30 conducts the burr removal while travelling through a specified stroke S2, which is shown in FIG. 3, at a speed synchronous with the moving speed of the square billet. After completing the burr removal, the travelling grinding machine 30 returns to the original position to repeat the burr removal action to succeeding welded part 12*a* in a similar procedure as preceding one. Following the procedure, the burr 12*b* on each welded part 12*a* is successively removed. The state after the burr removal is shown in FIG. 3(*b*). Since the welded part 12*a* is also rolled, accurate finish is not necessary.

Since the grinders 43 and 44 of the grinding devices 51 and 52 are set parallel to the longitudinal direction of the square billet 12, the ground slag generated during the grinding scatters downstream in a regulated direction. Accordingly, the ground slag generated by the grinder 43 of the grinding device 51 does not hit the downstream grinding device 52, and the ground slag coming from the grinding devices 51 and 52 is easily collected by the dust collecting hood 100. Furthermore, the collected slag is washed down with the flowing water film 107 which flows down on the inner face of the hood. Thus the treatment of ground slag becomes easy.

If the size of the square billet changes, prompt response is available without applying special action because only the change of swing and slide of the grinder 43 is required for the billet size change.

As described above, the burr-removal apparatus of the present invention enables the continuous rolling of square billets at a high productivity without raising the problem of time cycles owing to the adoption of two pairs (front and rear) of grinding devices for grinding and removing the burrs on the welded parts of square billets.

Since the scattering direction of the ground slag is restricted to a single direction, the collection and treatment of the ground slag is easily conducted.

What is claimed is:

1. A method for removing burrs in a continuous rolling process, comprising the steps of:

joining a rear end of a preceding moving billet with a front end of a succeeding moving billet using a flash butt welding method while both billets are moving in a travelling direction, to thereby form a welded part at a joined portion where the preceding and succeeding billets are joined; and grinding a burr on the welded part of the joined portion using a plurality of grinders while the billets are moving in said travelling direction and while rotating the grinders and moving the grinders synchronously with the travelling speed of the billets.

2. The method of claim 1, wherein at least one of the billets comprises a round billet, and the burr on the welded part is ground using the plurality of grinders arranged on a circumference of the round billet at an equal distance therebetween while revolving the grinders around the round billet in a circumferential direction of the round billet.

3. The method of claim 2, wherein the grinders are arranged at a tilted angle relative to the travelling direction of the billets.

4. The method of claim 1, wherein at least one of the billets comprises a rectangular billet having a rectangular cross section, the burr on the welded part is ground using the plurality of grinders which are arranged in pairs at above, below, and at both sides of the rectangular billet, and each pair of the grinders at above and below the rectangular billet are arranged with the billet kept away from a position of each pair of the grinders at both sides thereof along the travelling direction of the billet.

5. The method of claim 3, wherein the grinders are arranged at a tilted angle relative to the travelling direction of the billets.

6. The method of claim 3, wherein said at least one billet has a square cross section.

7. A method for removing a burr in a continuous rolling process, comprising the steps of:

detecting a welded part on billets for continuous rolling, which billets were welded at the welded part so as to be joined together by a travelling welder, using a sensor mounted to a travelling grinding machine located at a downstream side of the welder;

presetting a plurality of grinders mounted to the travelling grinding machine and continuously revolving the grinders relative to the billet immediately after detecting the welded part while moving the travelling grinding machine toward a downstream side of the billet, and accelerating the travelling grinding machine to a moving speed of the billet which is being continuously rolled;

detecting that the welded part of the billet has arrived at a position of the grinders; and removing a burr on the welded part by fixing the grinders at the preset position while travelling the travelling grinding machine with the speed of the billet rolling synchronously, after detecting the arrival of the welded part of the billet at the position of the grinders.

8. The method of claim 7 wherein the billets being joined are round billets, and the method further comprises a step of revolving a plurality of grinders arranged on a circumference of the round billets at an equal distance therebetween by a specified angle for removing a burr on the welded part.

9. The method of claim 7, further comprising a step of descending a support roll located directly downstream of a detection point after the detecting step of detecting the welded part of the billet, and ascending the support roll after a specified period of time has elapsed from the descending of the support roll.

10. The method of claim 7, wherein, after completing welding by the travelling welder, the travelling grinding machine moves upstream of the billet travelling line until the welded part on the billet is detected, and then, at the beginning of a grinding operation, the travelling welder moves downstream of the billet travelling line synchronously with a rolling speed of the billet.

11. A method for removing a burr in a continuous rolling process, comprising the steps of:

scattering ground chips generated by grinding a burr on a welded part of a billet toward a downstream side of a billet travelling line within a limited direction during moving of a travelling grinding machine;

placing a hood on a downstream side of the travelling grinding machine while facing the hood against the scattering direction of the ground chips, and forming a water film on an inner surface of the hood by flowing water down along the inner surface of the hood; and collecting the ground chips with the hood, whereby said ground chips continuously flow down along with the water film on the inner surface of the hood.

12. The method of claim 11, comprising providing the hood with an opening for passing the billet therethrough, and a billet cover at the opening for preventing the billet from being exposed to the water film.

13. A grinding machine for continuously rolling a round billet, comprising:

a travelling body shuttling along a moving direction of the round billet;

a turret ring supported by the travelling body so as to be rotatable on the travelling body about a center axis of the turret ring; and a plurality of grinding devices arranged movably along a radius of the turret ring;

wherein the grinding devices comprise respective grinders which are set at a tilted angle relative to a center axis of the turret ring.

14. The grinding machine of claim 13, further comprising a dust-collecting hood mounted to the travelling body, the hood having a water-spray nozzle on an inside thereof.

15. The grinding machine of claim 13, further comprising a sensor for detecting a welded part on a billet on an upstream side of the grinding devices.

16. A grinding machine for continuously rolling a rectangular billet, comprising:

a travelling body moving along a moving direction of the rectangular billet;

two pairs of grinding devices located at a front side and a rear side, respectively, of the travelling body, and having grinders which rotate on a plane facing the rectangular billet and along a longitudinal direction of the rectangular billet;

a moving device for moving the grinding devices in a right angle direction relative to the rectangular billet; and a device for moving the grinders to come close to and apart from the rectangular billet.

17. The grinding machine of claim 15, further comprising a dust-collecting hood mounted to the travelling body, the hood having a water-spray nozzle on an inside thereof.

18. The grinding machine of claim 16, wherein said billet is square in cross section, and said grinders are arranged to rotate on a plane facing said square billet.

* * * * *

UNITED STATES PATENT AND TRADEMARK OFFICE

CERTIFICATE OF CORRECTION

PATENT NO. : 5,709,585
DATED : January 20, 1998
INVENTOR(S) : MATSUO et al.

It is certified that error appears in the above-identified patent and that said Letters Patent is hereby corrected as shown below:

Title page,
Item [56] References Cited, under "U.S. PATENT DOCUMENTS", insert

--2,282,508 5/42 J.L. Anderson 2,556,160 6/51 J.G. Ayers 3,011,255 12/61 C.W. Washburn et al.

3,259,969 7/66 A.H. Tessman 3,621,176 11/71 Valente 3,755,884 9/73 Dupy 3,913,275 10/75 Brawley 3,976,815 8/76 Brekle 4,346,534 8/82 Czubak--;
3,934,324 1/76 Hess et al.

UNITED STATES PATENT AND TRADEMARK OFFICE

CERTIFICATE OF CORRECTION

PATENT NO. : 5,709,585
DATED : January 20, 1998
INVENTOR(S) : MATSUO et al.

It is certified that error appears in the above-identified patent and that said Letters Patent is hereby corrected as shown below:

Column 1, line 31, change "bur-" to --burr--; and change "substantial" to --sustained--;

Column 1, line 55, after "burr" insert --is--;

Column 15, line 47, change "ones" to --over--;

Column 16, line 42, change "facilityu" to --facility--;

Column 18, line 56 (claim 5, line 1), change "claim 3" to --claim 4--;

Column 20, line 41 (claim 17, line 41), change "claim 15" to --claim 16--.

Signed and Sealed this

Sixth Day of February, 2001

*Attest:*

*Attesting Officer*

Q. TODD DICKINSON

*Director of Patents and Trademarks*